US012228134B2

(12) United States Patent
Hayase

(10) Patent No.: US 12,228,134 B2
(45) Date of Patent: Feb. 18, 2025

(54) CONSTANT-FLOW PULSELESS ROTARY-VANE-TYPE DISPLACEMENT MACHINE

(71) Applicant: Isao Hayase, Tsukuba (JP)

(72) Inventor: Isao Hayase, Tsukuba (JP)

( * ) Notice: Subject to any disclaimer, the term of this patent is extended or adjusted under 35 U.S.C. 154(b) by 0 days.

(21) Appl. No.: 18/585,174

(22) Filed: Feb. 23, 2024

(65) Prior Publication Data

US 2024/0191711 A1 Jun. 13, 2024

Related U.S. Application Data

(63) Continuation of application No. PCT/JP2022/031966, filed on Aug. 24, 2022.

(30) Foreign Application Priority Data

Aug. 25, 2021 (JP) ..... 2021-157265

(51) Int. Cl.
*F04C 2/34* (2006.01)
*F04C 2/344* (2006.01)

(52) U.S. Cl.
CPC ..... *F04C 2/3441* (2013.01); *F04C 2240/50* (2013.01)

(58) Field of Classification Search
CPC ..... F04C 2/3441; F04C 2/344; F04C 2/34; F04C 2/3446; F04C 2/3448; F04C 2/348; F04C 2/352; F04C 2/3447; F04C 2/3442; F04C 2/3443; F04C 2/3445; F04C 2240/50; F04C 2240/60; F04C 2240/20; F04C 2240/56; F04C 2240/54; F04C 2240/52;

(Continued)

(56) References Cited

U.S. PATENT DOCUMENTS 4,373,880 A 2/1983 Tanaka et al.
4,738,603 A * 4/1988 Hattori ..... F01C 21/106 418/150

(Continued)

FOREIGN PATENT DOCUMENTS

JP H02-108886 A 4/1990
JP H03-210087 A 9/1991

(Continued)

OTHER PUBLICATIONS

JP 2019-157681 (Year: 2024).*

(Continued)

*Primary Examiner* — Dapinder Singh
(74) *Attorney, Agent, or Firm* — WHDA, LLP

(57) ABSTRACT

There is provided a technology of which main object is reduction of a flow rate fluctuation of working fluid and vibration reduction by suppression of a pressure pulsation therewith and which is also for reducing a pulse-like pressure pulsation, an exciting force, and leakage that occur when ports that communicate with a working chamber are switched at the same time in a rotary-vane-type displacement machine. A change pattern of each working chamber volume determined by the motion of vanes pressed against a cam-ring inner circumferential surface is improved and the fluctuation of the entire flow rate that is a time change of the total volume of each working chamber is reduced by devising the profile of the cam-ring inner circumferential surface.

17 Claims, 38 Drawing Sheets

(58) Field of Classification Search
CPC .. F04C 18/0215; F04C 29/00; F04C 29/0057; F01C 21/02; F01C 21/108; F01C 21/10; F01C 21/0809; F01C 21/0836; F01C 21/08; F01C 21/106
See application file for complete search history.

(56) References Cited

U.S. PATENT DOCUMENTS

| | | | | |
|---|---|---|---|---|
| 8,182,248 | B2 * | 5/2012 | Cygnor | F04C 14/226 418/24 |
| 11,644,301 | B1 * | 5/2023 | Katzenmeyer | G01B 9/02067 356/477 |
| 2002/0064471 | A1 | 5/2002 | Kojima et al. | |
| 2019/0154016 | A1 | 5/2019 | Ono et al. | |

FOREIGN PATENT DOCUMENTS

| | | | |
|---|---|---|---|
| JP | 2002-115673 | A | 4/2002 |
| JP | 2018-145953 | A | 9/2018 |
| JP | 2019-124216 | A | 7/2019 |
| JP | 2019-157681 | A | 9/2019 |

OTHER PUBLICATIONS

International Search Report dated Nov. 8, 2022, issued in counterpart International Application No. PCT/JP2022/031966 (4 pages).

* cited by examiner

[Fig. 1]
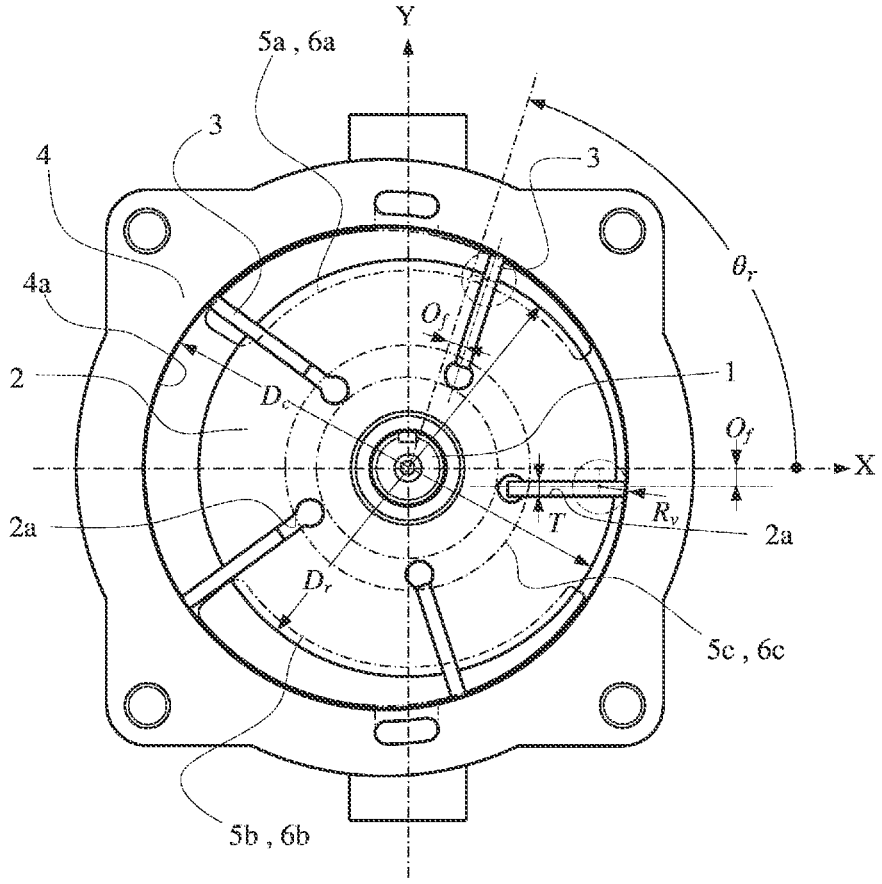

[Fig. 2]
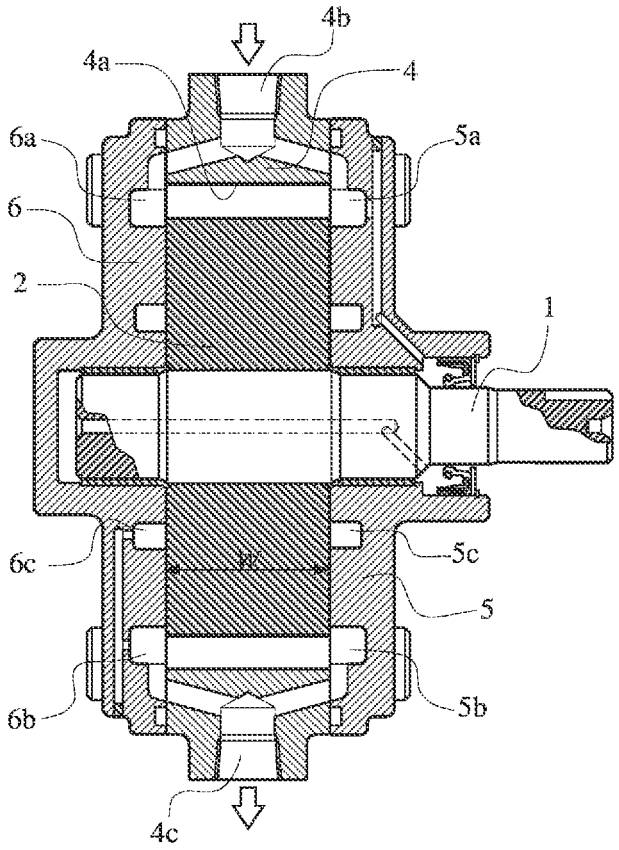

[Fig. 3]
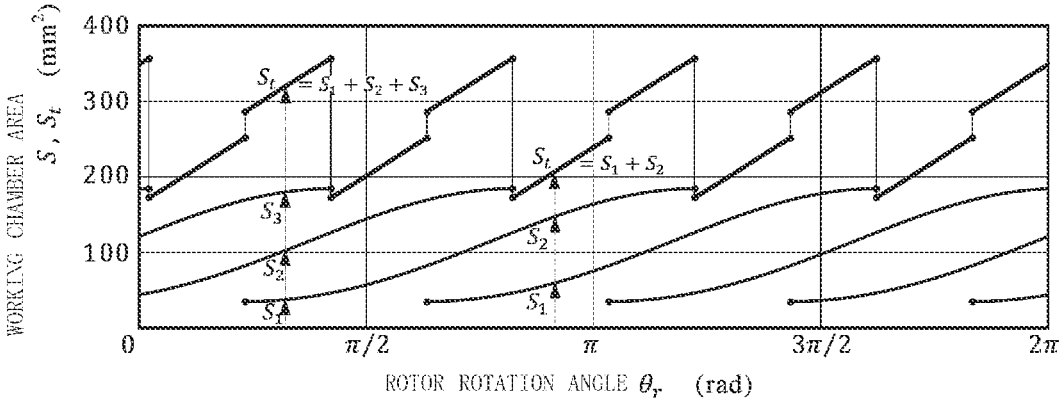

[Fig. 4]
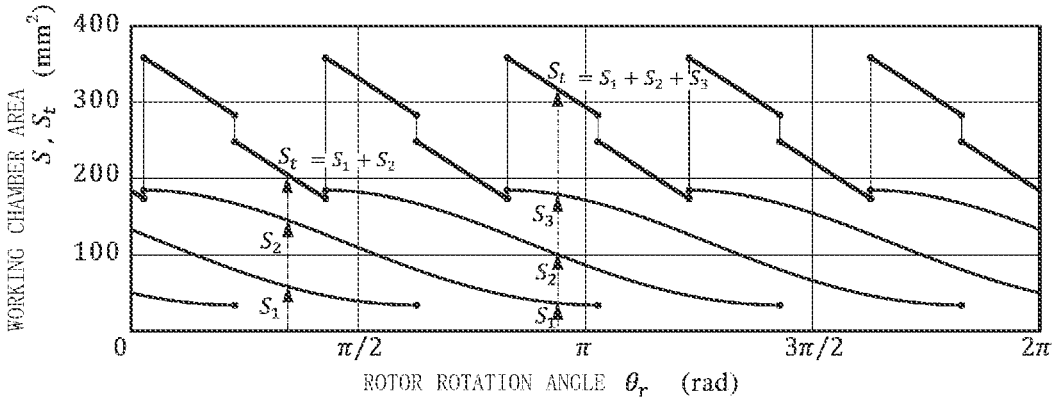

[Fig. 5]
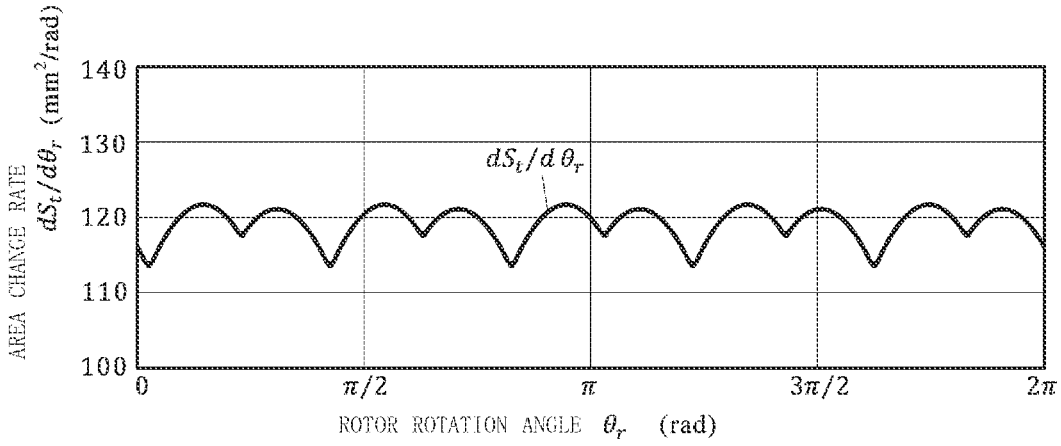

[Fig. 6]
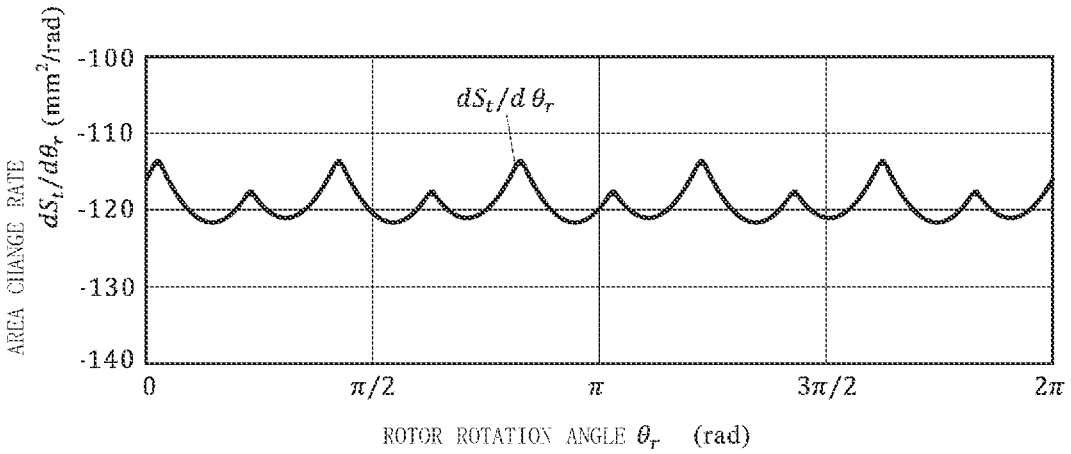

[Fig. 7]
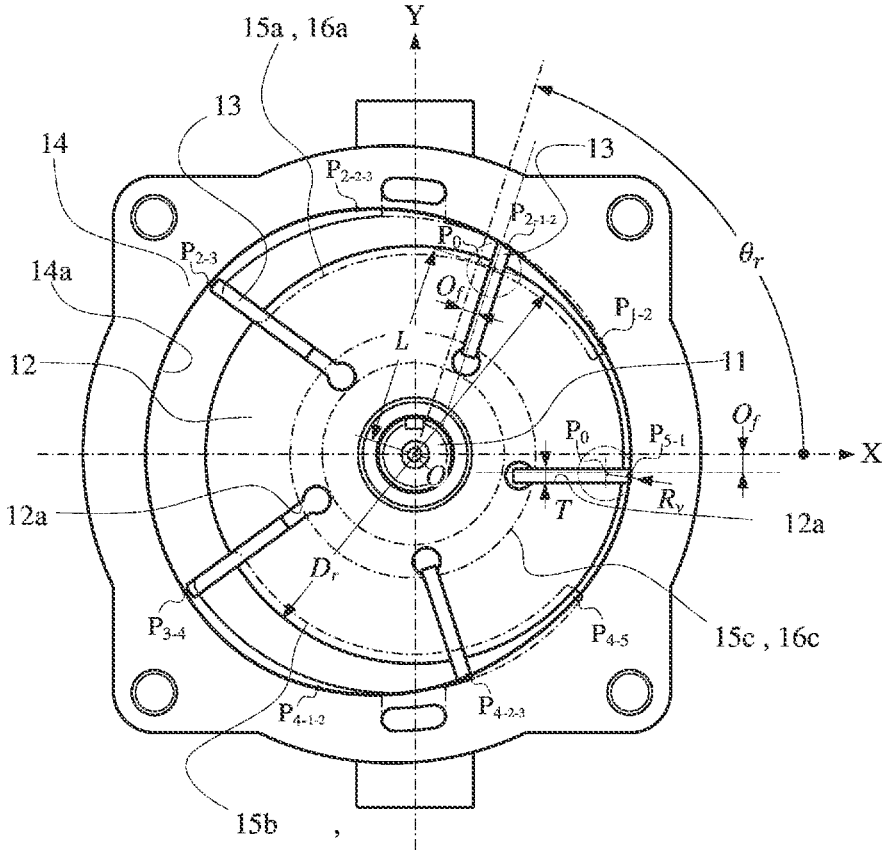

[Fig. 8]
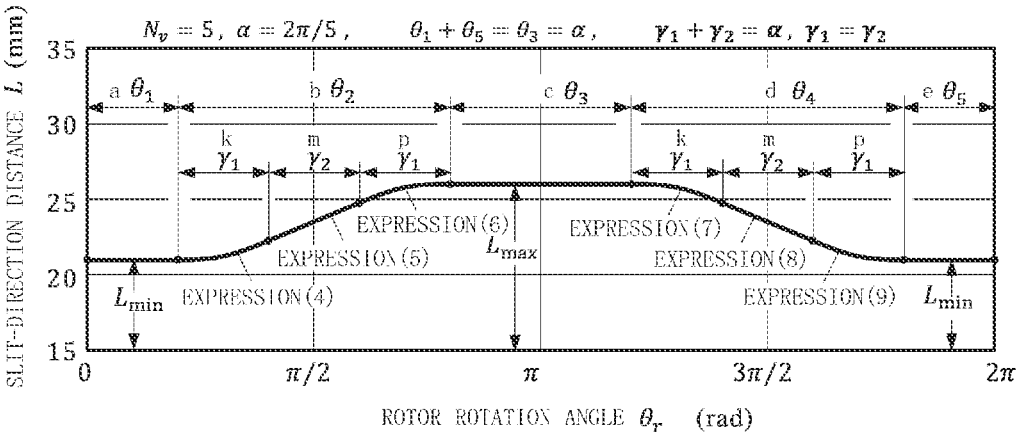
a:FIRST INTERVAL
b:SECOND INTERVAL
c:THIRD INTERVAL
d:FOURTH INTERVAL
e:FIFTH INTERVAL
k:FIRST PORTION
m:SECOND PORTION
p:THIRD PORTION

[Fig. 9]
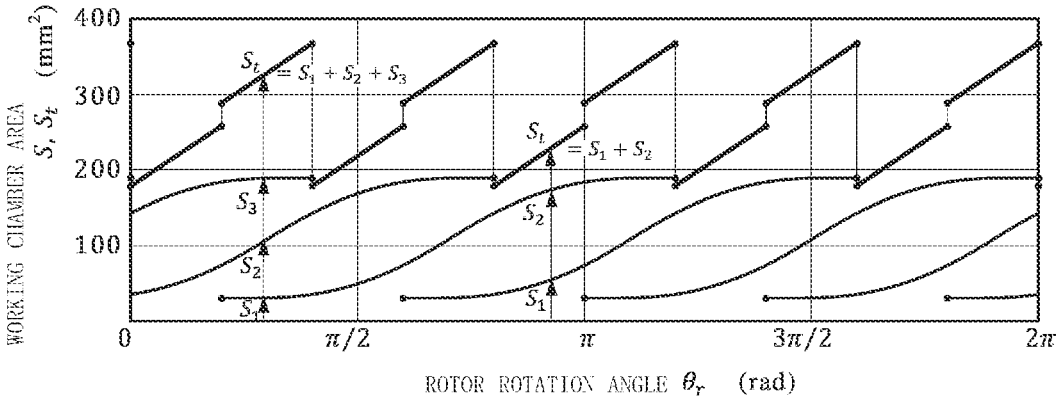

[Fig. 10]
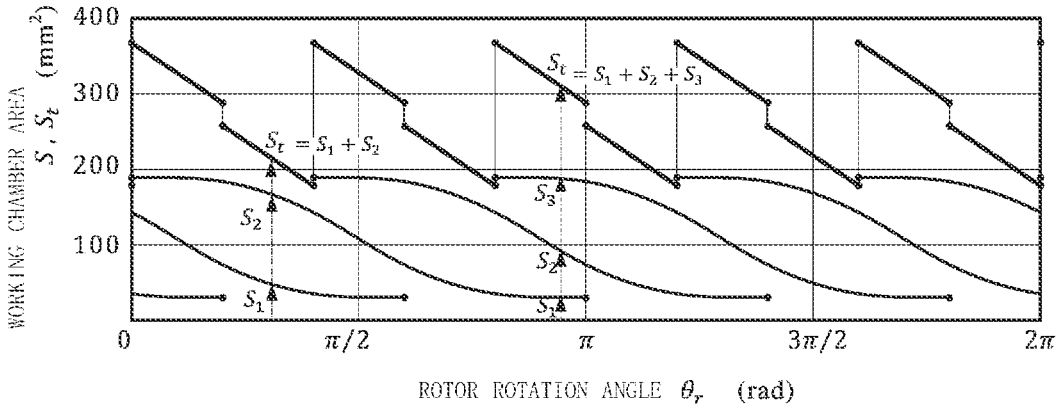

[Fig. 11]
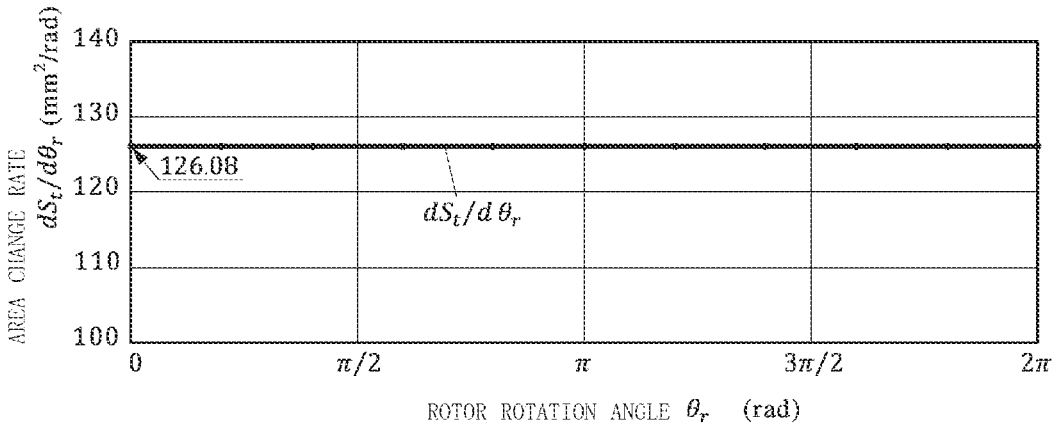

[Fig. 12]
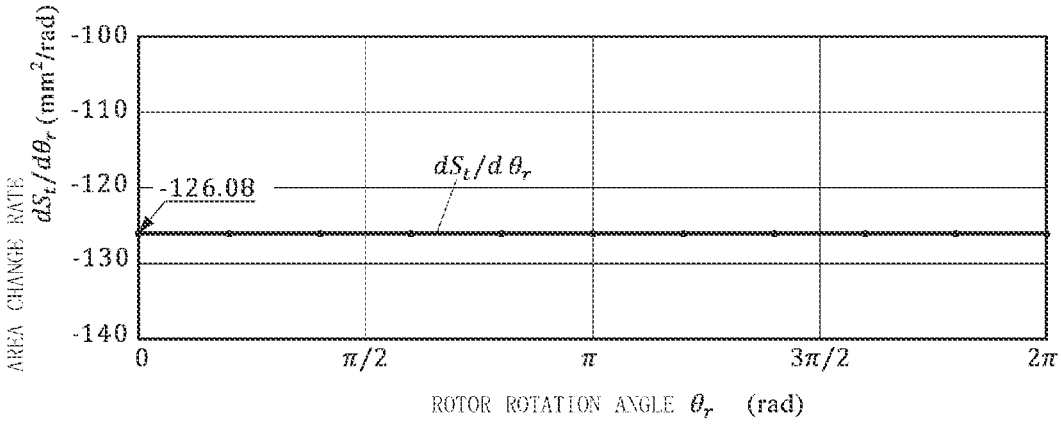

[Fig. 13]
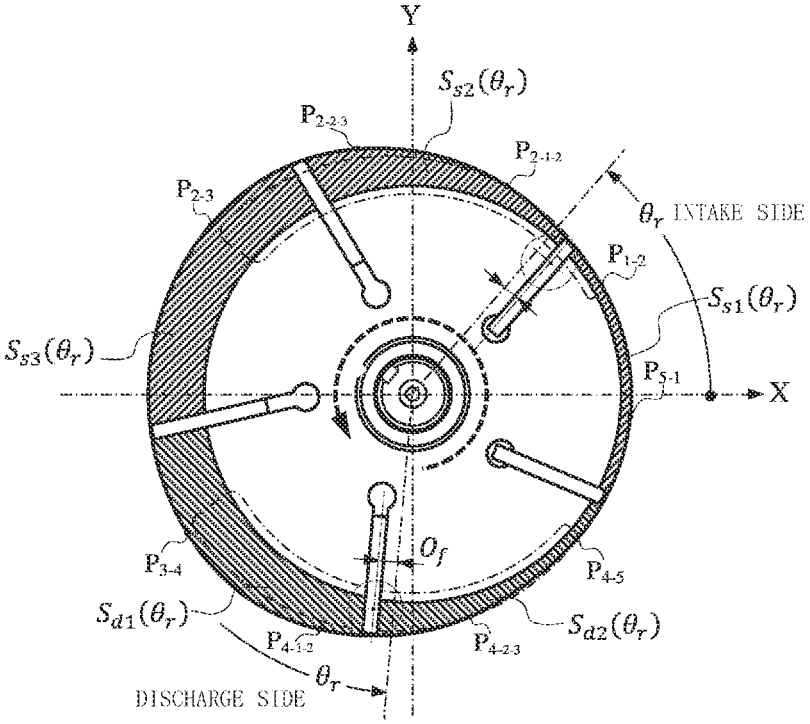

[Fig. 14]
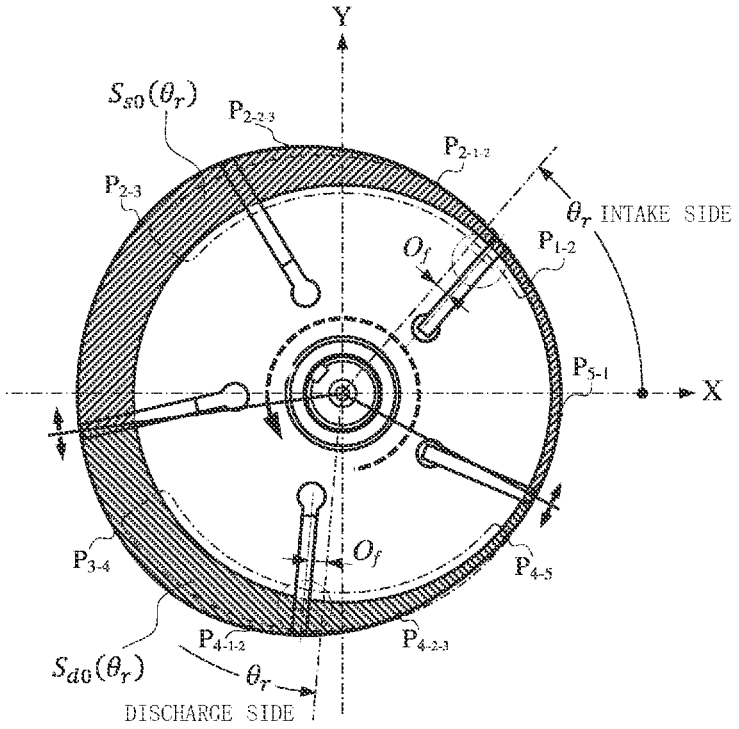

[Fig. 15]
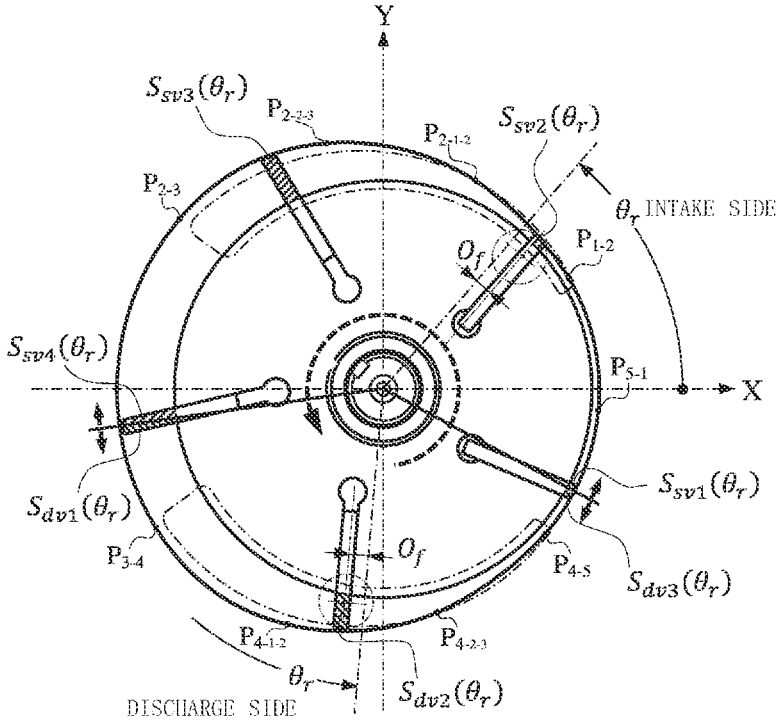

[Fig. 16]
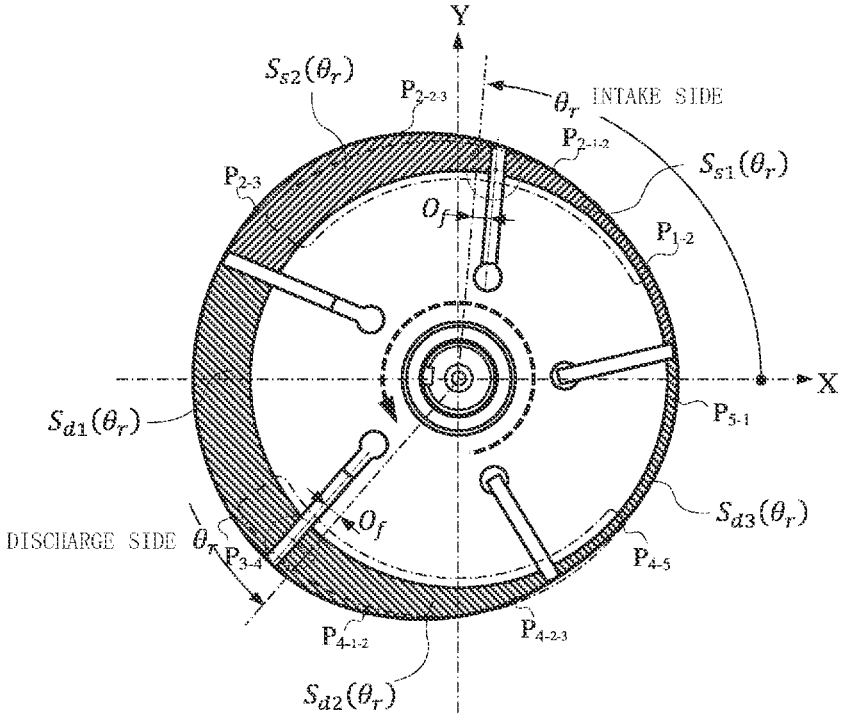

[Fig. 17]
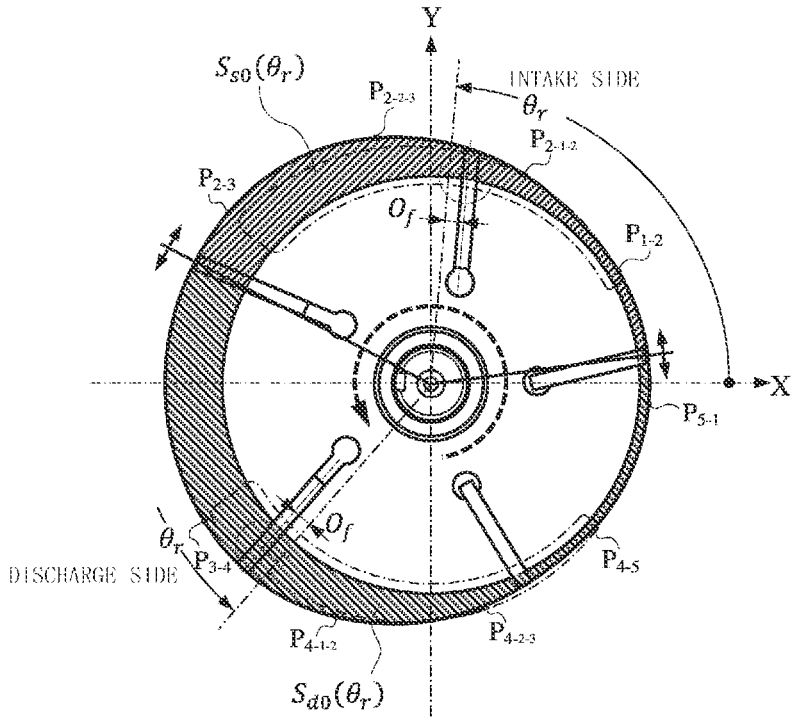

[Fig. 18]
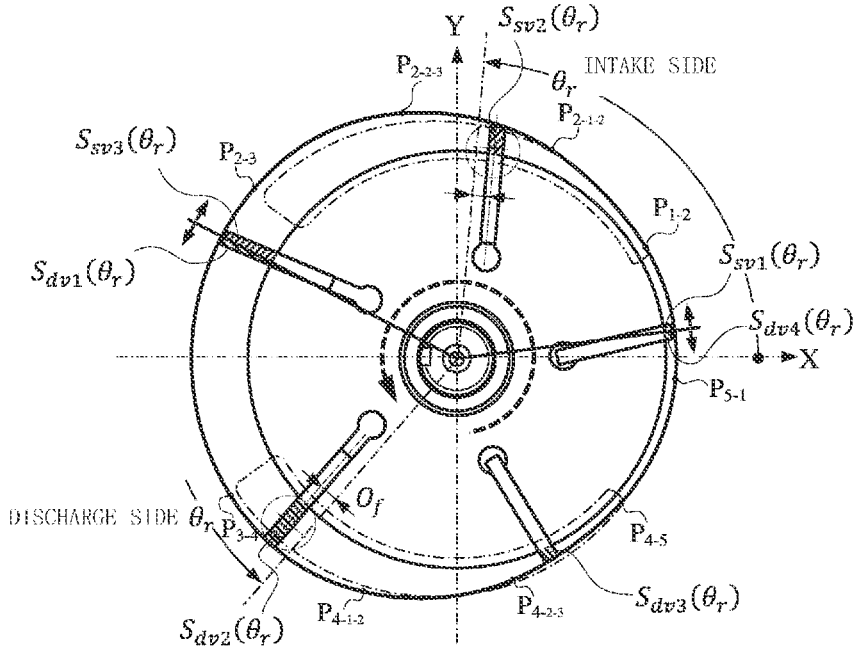

[Fig. 19]
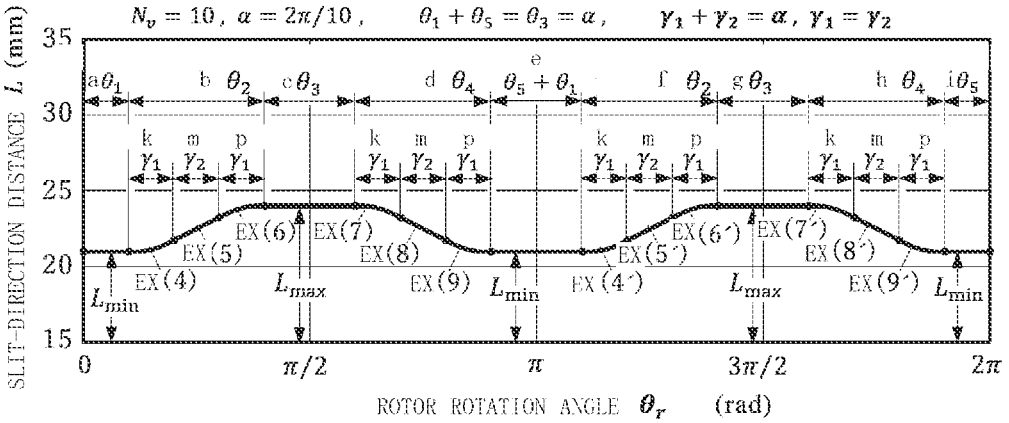
a:FIRST INTERVAL
b:SECOND INTERVAL
c:THIRD INTERVAL
d:FOURTH INTERVAL
e:FIFTH INTERVAL + FIRST' INTERVAL
f:SECOND' INTERVAL
g:THIRD' INTERVAL
h:FOURTH' INTERVAL
i:FIFTH' INTERVAL
k:FIRST PORTION
m:SECOND PORTION
p:THIRD PORTION
EX:EXPRESSION

[Fig. 20]
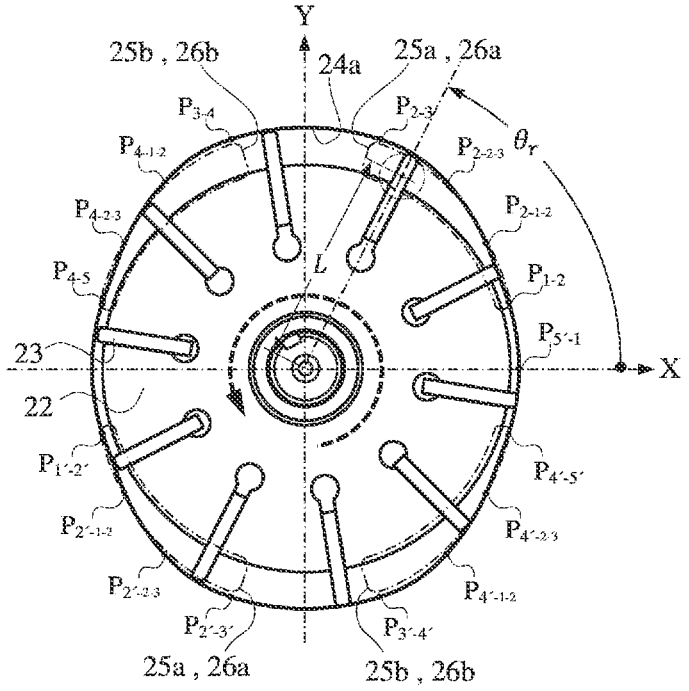

[Fig. 21]
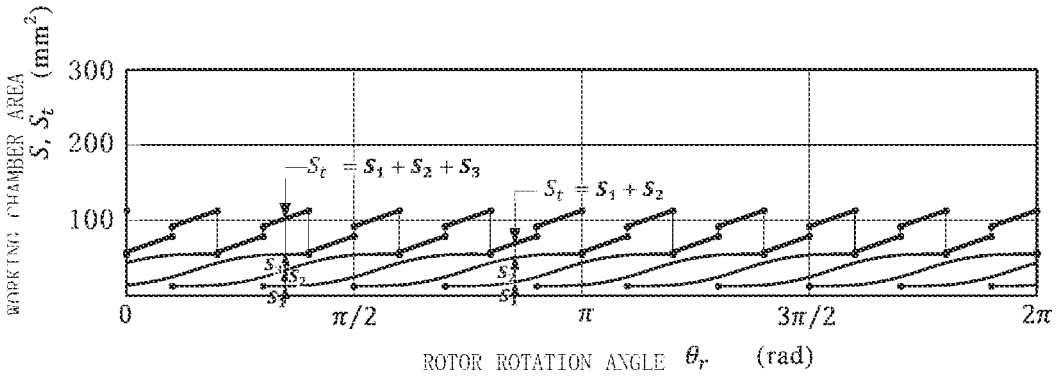

[Fig. 22]
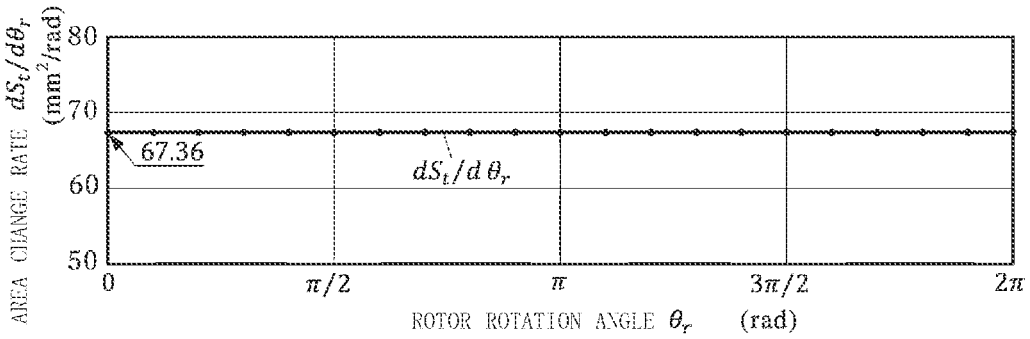

[Fig. 23]
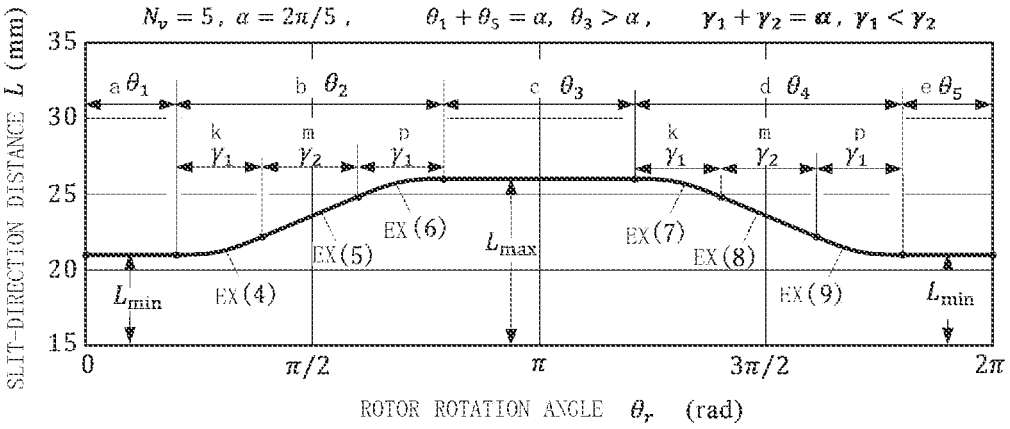
a:FIRST INTERVAL
b:SECOND INTERVAL
c:THIRD INTERVAL
d:FOURTH INTERVAL
e:FIFTH INTERVAL
k:FIRST PORTION
m:SECOND PORTION
p:THIRD PORTION
EX:EXPRESSION

[Fig. 24]
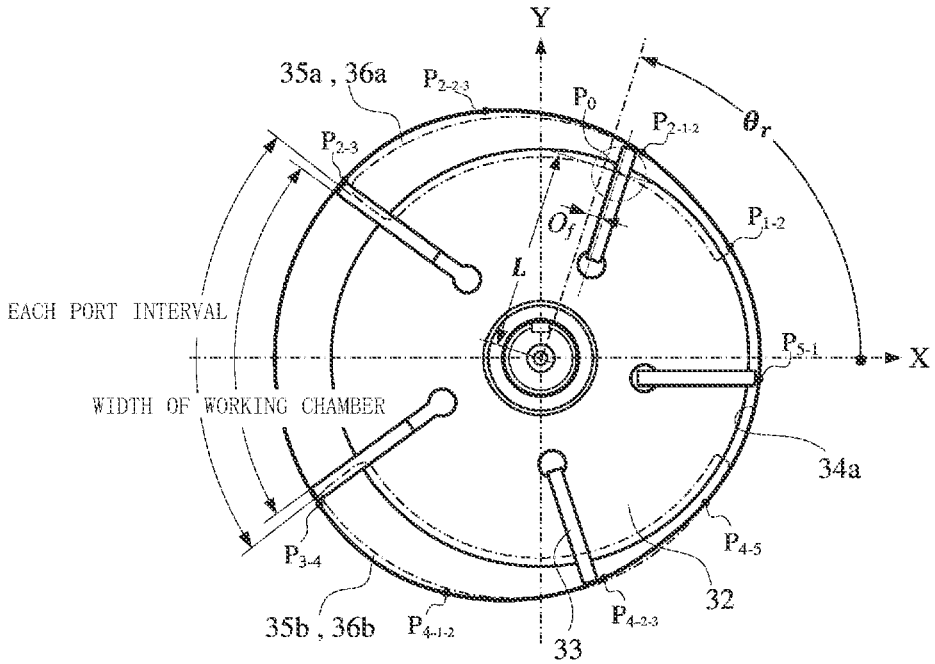

[Fig. 25]
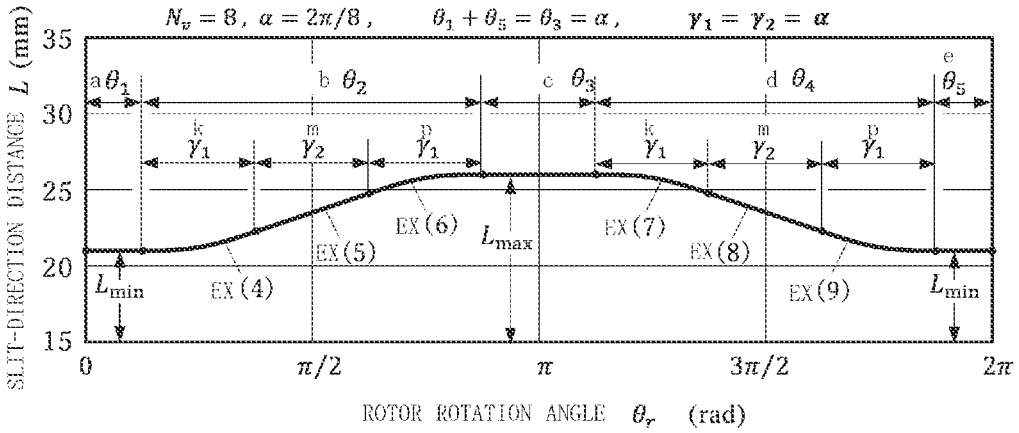
a:FIRST INTERVAL
b:SECOND INTERVAL
c:THIRD INTERVAL
d:FOURTH INTERVAL
e:FIFTH INTERVAL
k:FIRST PORTION
m:SECOND PORTION
p:THIRD PORTION
EX:EXPRESSION

[Fig. 26]
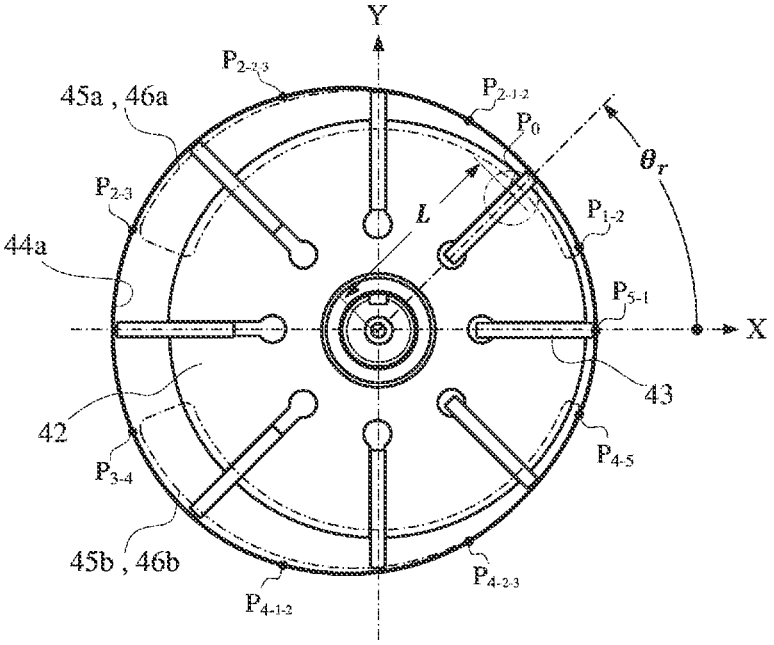

[Fig. 27]
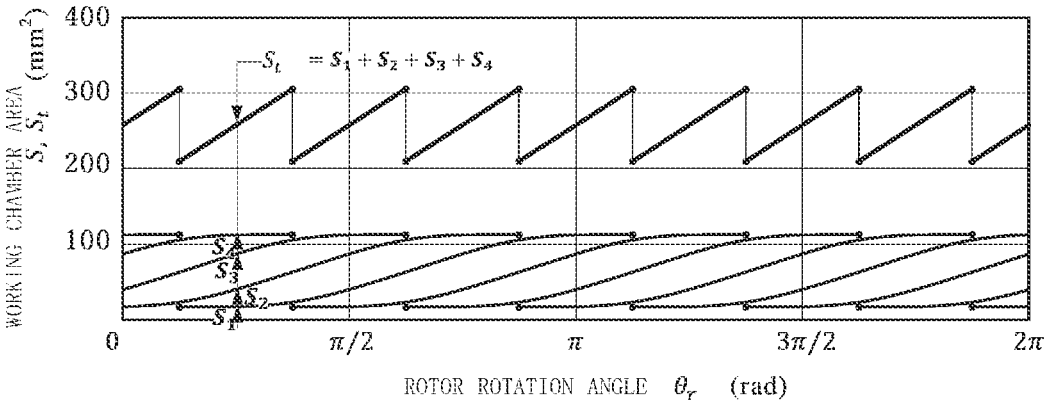

[Fig. 28]
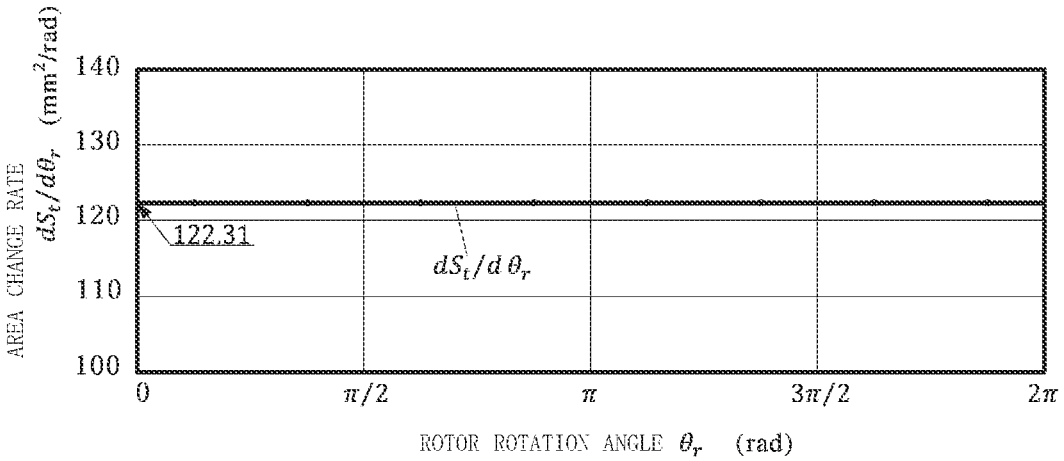

[Fig. 29]
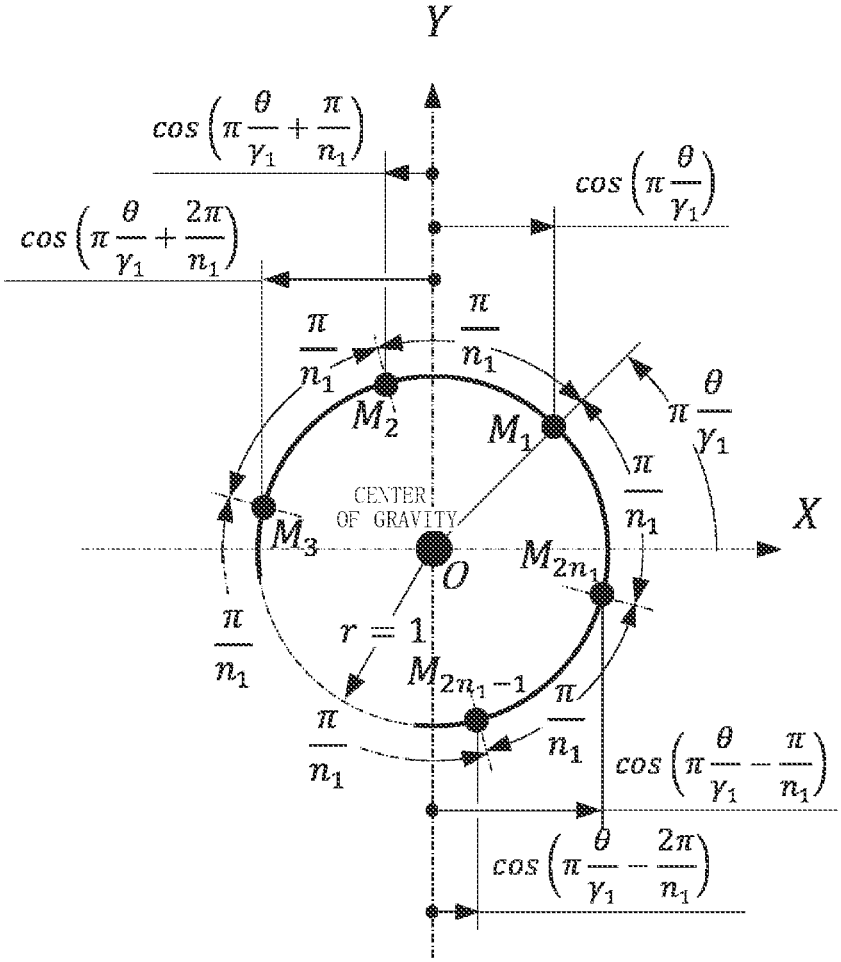

[Fig. 30]
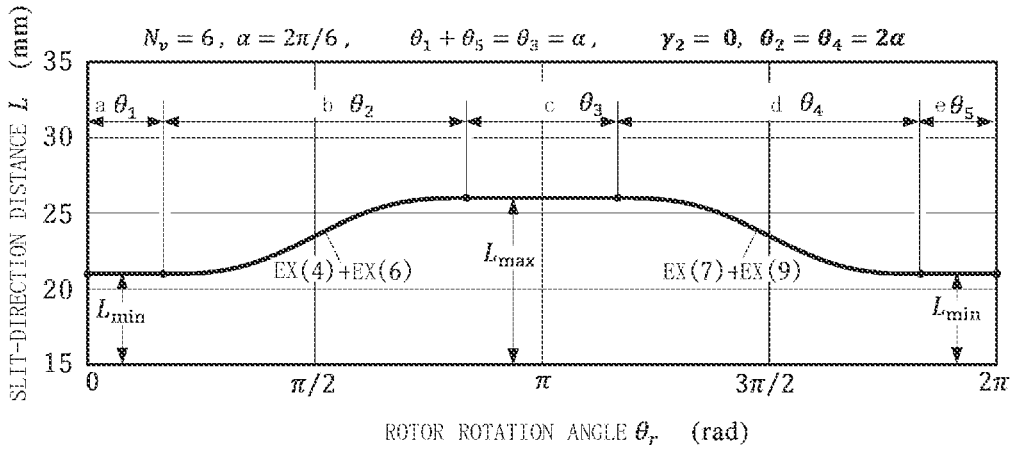
a:FIRST INTERVAL
b:SECOND INTERVAL
c:THIRD INTERVAL
d:FOURTH INTERVAL
e:FIFTH INTERVAL
EX:EXPRESSION

[Fig. 31]
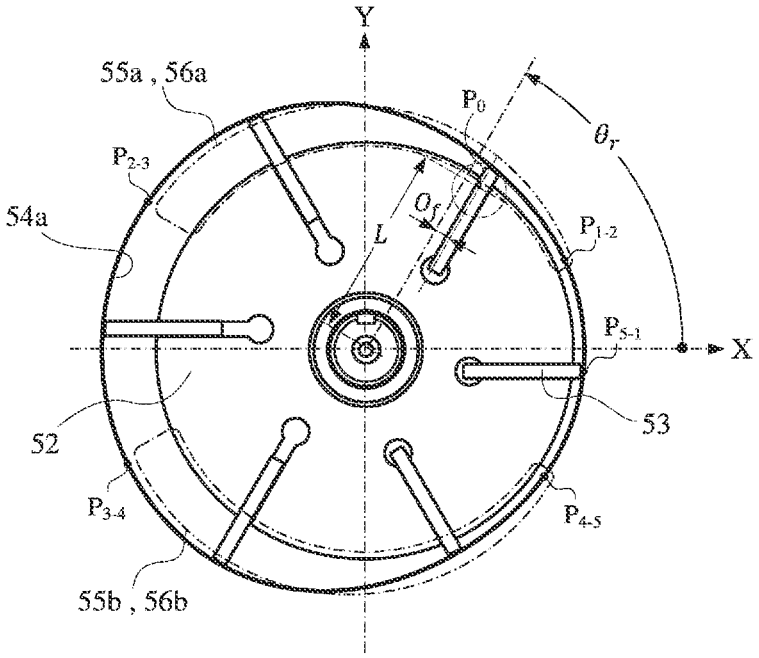

[Fig. 32]
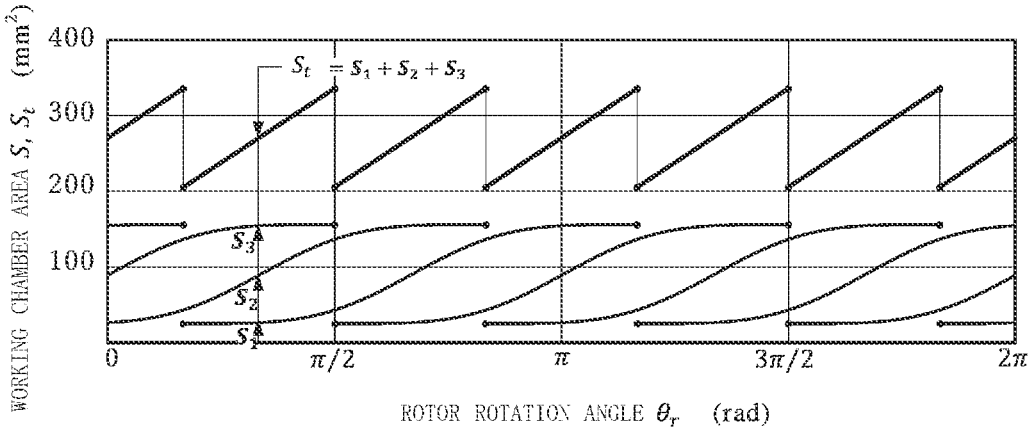

[Fig. 33]
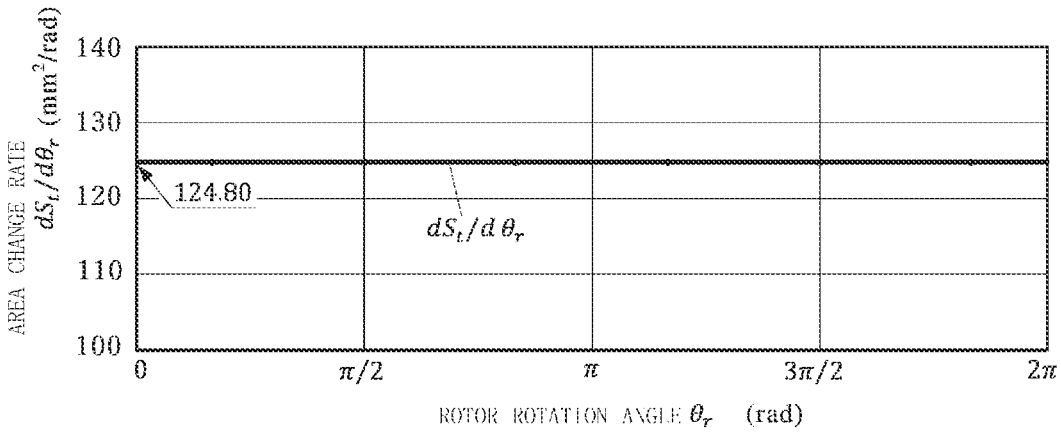

[Fig. 34]
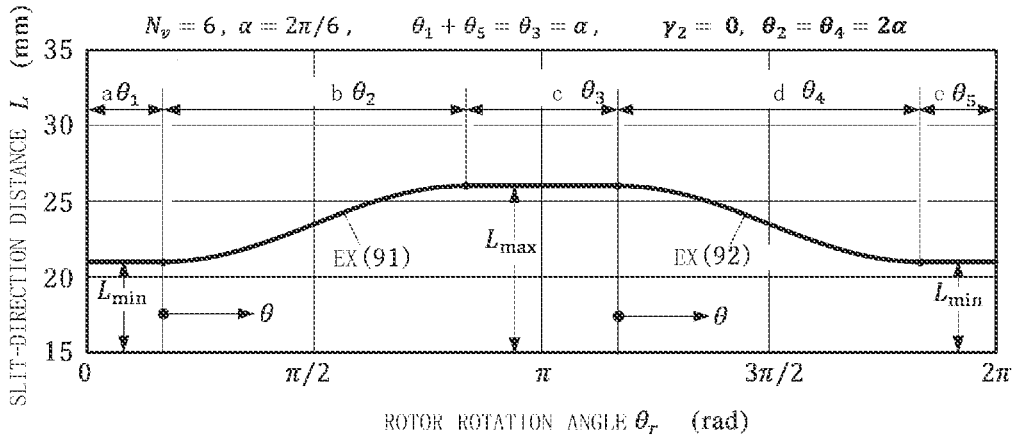
a:FIRST INTERVAL
b:SECOND INTERVAL
c:THIRD INTERVAL
d:FOURTH INTERVAL
e:FIFTH INTERVAL
EX:EXPRESSION

[Fig. 35]
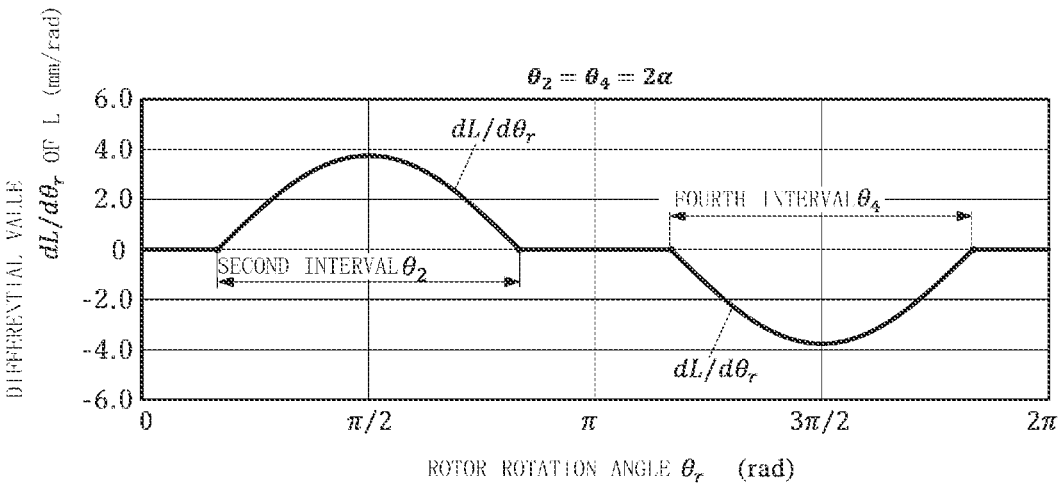

[Fig. 36]
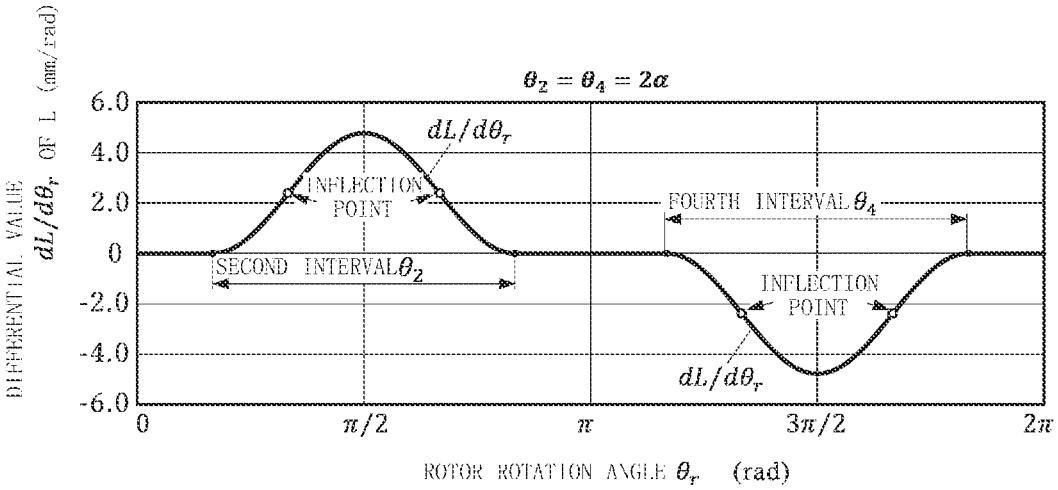

[Fig. 37]
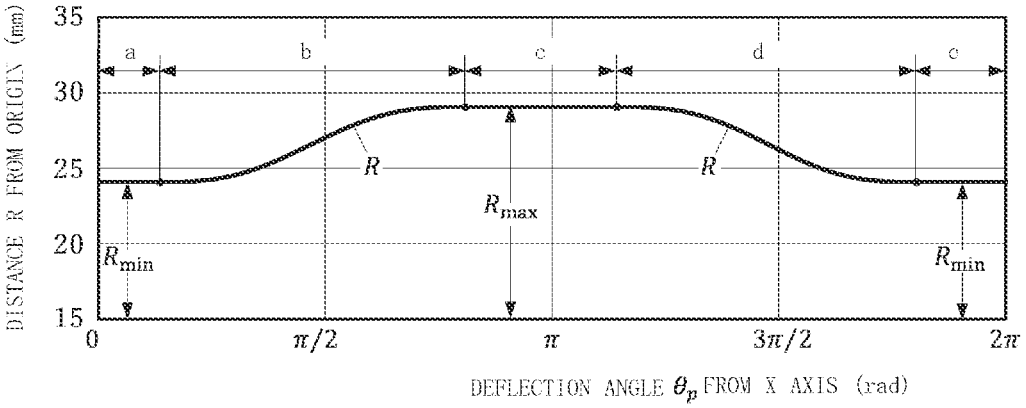
a:CORRESPONDING TO FIRST INTERVAL
b:CORRESPONDING TO SECOND INTERVAL
c:CORRESPONDING TO THIRD INTERVAL
d:CORRESPONDING TO FOURTH INTERVAL
e:CORRESPONDING TO FIFTH INTERVAL

[Fig. 38]
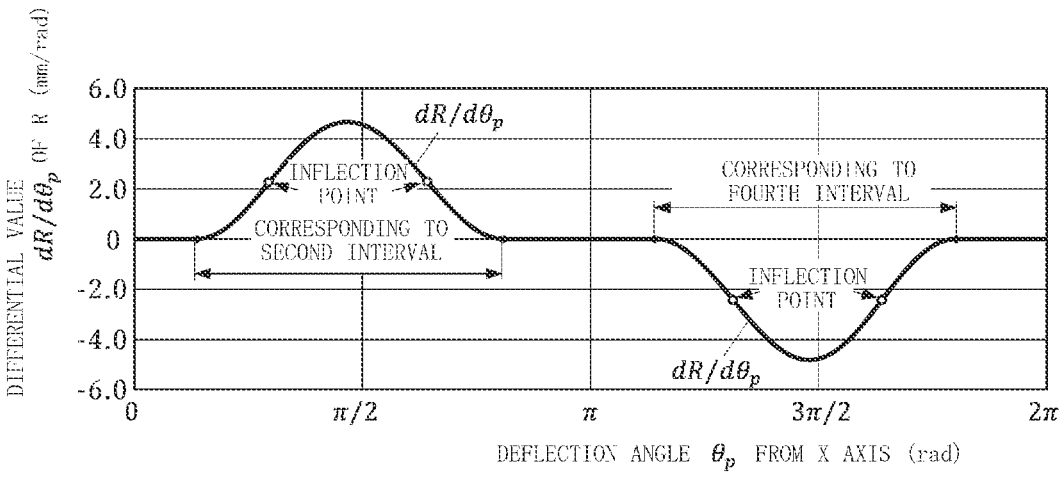

CONSTANT-FLOW PULSELESS ROTARY-VANE-TYPE DISPLACEMENT MACHINE

TECHNICAL FIELD

The present invention relates to a rotary-vane-type displacement machine in general and particularly relates to a hydraulic pump of the same type used in pressure feed of liquid and a hydraulic motor of the same type that generates a driving torque by pressure of liquid.

BACKGROUND ART

In a hydraulic pump and a hydraulic motor that are displacement machines of the related art, a periodical flow rate fluctuation occurs even when a main shaft rotates at a fixed speed. In a constant volume pump and the like, the flow rate fluctuation itself, which causes an error in an injection amount, has been a problem. However, when the density of the working fluid is great, a great inertial force is generated in accordance with the flow rate fluctuation, and a pressure pulsation in pipes causes vibration and noise. This also has been a great general problem of the displacement machine of which working fluid is liquid.

As a related-art countermeasure against the above, a countermeasure of reducing the flow rate fluctuation and suppressing the pressure pulsation by increasing the number of vanes and increasing the number of working chambers of which phases are different has been taken in a rotary vane type, for example. However, the countermeasure also has disadvantages such as an increase in the number of parts and an increase in friction loss, and the flow rate fluctuation cannot be completely removed. Therefore, the problems of vibration and noise due to the pressure pulsation in the pipes have not been completely solved and have remained.

FIG. 1 and FIG. 2 show a related-art structure example of a rotary-vane-type hydraulic pump. A shaft member 1 and a rotor 2 are coaxially connected to each other, and five vanes 3 slidably fitted in five rotor slits 2*a*, a cam ring 4 fixed to a periphery of the rotor 2, and two side plates 5, 6 that close both end surfaces thereof and rotatably support the shaft member 1 are included. The shape of an inner circumferential surface 4*a* of the cam ring in FIG. 1 is a perfect circle of which center is in a position eccentric from a shaft central axis in the related-art structure example.

In the structure as in FIG. 1 and FIG. 2, the liquid is sucked and discharged as a result of driving the shaft member 1 be rotated in a state in which a distal end of each vane 3 is in contact with the inner circumferential surface 4*a* of the cam ring and increasing and decreasing each working chamber volume formed by the rotor 2, the cam-ring inner circumferential surface 4*a*, the two adjacent vanes 3, and the side plates 5, 6. On the contrary, a hydraulic motor is obtained when the volume of each working chamber is increased and decreased by the pressure of the liquid and rotation and driving are performed by using the shaft member 1 as an output shaft.

In FIG. 1, the working chamber of which volume is increasing in accordance with the rotation of the shaft member 1 is in a suction stroke, and the working chamber of which volume is decreasing in accordance with the rotation of the shaft member 1 is in a discharge stroke. By causing each working chamber in each stroke to communicate with suction ports 5*a*, 6*a* and discharge ports 5*b*, 6*b* indicated by one-dot chain lines, the suction from the upstream side and the discharge to the downstream side are performed. The compressibility of the liquid can be substantially ignored, and hence the pump flow rate (volumetric flow rate per unit time) in each stroke becomes a sum of the time change rate of the volume (volume change amount per unit time) of each working chamber in the stroke.

A change of an area S of each working chamber in the suction stroke in the related-art structure example in FIG. 1 seen from the front and a total area $S_t$ thereof is shown in FIG. 3, and a change of the above in the discharge stroke is similarly shown in FIG. 4 as functions of a rotor rotation angle $\theta_r$. Here, $\theta_r$ is a rotor rotation angle based on the time when one of the rotor slits 2*a* faces the X-axis positive direction in FIG. 1. FIG. 5 is a differential curve of the total area $S_t$ in FIG. 3 in the suction stroke by $\theta_r$, and FIG. 6 is a differential curve of the total area $S_t$ in FIG. 4 in the discharge stroke by $\theta_r$. When the thickness of the cam ring 4 is represented by W and $\theta_r=\omega t$ ($\omega$: an angular velocity that is a fixed value) is satisfied, a differential curve of each total volume by time t is obtained by multiplying a differential curve by $\theta_r$ by a fixed factor of $W\cdot\omega$. Therefore, FIG. 5 and FIG. 6 show the change patterns of the pump flow rates on the suction side and the discharge side, respectively, and it can be understood that there is a periodical change in the pump flow rates in the related-art structure example. Calculation conditions of each working chamber area $S_n$ and the total area $S_t$ thereof in FIG. 3 and FIG. 4 are a rotor diameter: $D_r$=46 mm, the number of vanes: $N_v$=5, a vane distal-end circular-arc radius: $R_v$=3 mm, a distal-end circular-arc-center offset: $O_f$=2 mm, a vane thickness: T=1.6 mm, a cam ring perfect circle diameter: $D_c$=53.2 mm, and a cam ring center eccentricity amount: $\Delta c$=2.5 mm in FIG. 1.

The pressure of each working chamber in the rotary-vane-type hydraulic pump and the hydraulic motor that are the subjects of the present invention discontinuously changes at the moment when the port that communicates with the working chamber is switched from one of the suction port and the discharge port to the other. For example, a rapid pressure rise occurs at the moment when the communication with the suction port is blocked and communication is newly established with the discharge port in the hydraulic pump. This is because working fluid liquid on the discharge port side that is higher in pressure than the working chamber momentarily backflows to the working chamber by a minute amount. As above, in the rotary-vane-type hydraulic pump and the hydraulic motor, a pulse-like pressure pulsation and an exciting force also occur.

As an approach of reducing the pulse-like pressure pulsation, an approach of starting communication with the working chamber via a notch portion provided in a communication starting portion with a new port is conceived. A communication passage area while communication is performed via the notch portion is extremely small, and hence the passage resistance thereof suppresses momentary movement of the working fluid liquid due to the pressure difference by thereby alleviating the pulse-like pressure pulsation and the exciting force due to the pulse-like pressure pulsation.

CITATION LIST

Patent Literature

[Patent Literature 1] Japanese Patent Laid-Open No. 2018-145953

SUMMARY OF INVENTION

Technical Problem

As means for reducing the pressure pulsation due to the flow rate fluctuation in the pipes on the suction side and the discharge side in the rotary-vane-type hydraulic pump and the hydraulic motor in the related-art technology, there is an approach of increasing the number of the rotor slits 2*a* and the vanes 3, increasing the number of the working chambers, thereby reducing the flow rate fluctuation in FIG. 1, for example. However, as described above, this approach has disadvantages such as the increase of the number of parts and the increase of the friction loss. In addition, the flow rate fluctuation cannot be completely removed.

A first problem to be solved by the present invention is to provide an approach of reducing a periodical pressure pulsation generated by a flow rate fluctuation of working fluid in a rotary-vane-type hydraulic pump and a hydraulic motor in a more significant manner without causing adverse effects such as an increase of a mechanical friction loss and an increase of cost due to an increase of the number of parts and the like.

Next, a volume change of a working chamber of the rotary-vane-type displacement machine restarts immediately after communication with a new port starts, and the movement of the working fluid liquid starts via the port. The movement speed immediately increases and becomes a great value. Therefore, for example, the area communicating with the newly communicating discharge port in the hydraulic pump and the like needs to be promptly enlarged in order to prevent the adverse effects of an abnormal rise of pressure in the working chamber caused by the passage resistance.

Therefore, the communication passage between the working chamber and the newly communicating port in the rotary-vane-type displacement machine needs to be designed so as to respond to conflicting demands, that is, a demand to cause the communication passage area immediately after the occurrence of communication to be minute in order to alleviate the pulse-like pressure pulsation and the exciting force and a demand to promptly enlarge the communication passage area in order to prevent the adverse effects such as the abnormal pressure rise of the working chamber described above at the same time.

A second problem to be solved by the present invention is to also alleviate the pulse-like pressure pulsation and the exciting force due to a pressure difference when the ports with which communication is established are switched and to perform the alleviation without increasing the passage resistance of the flow of the working fluid due to the volume change of the working chamber after the communication with new port starts in the rotary-vane-type hydraulic pump and the hydraulic motor. Means for the second problem and means for the first problem are to be both satisfied and realized at the same time.

Solution to Problem

In the means of the present invention for solving the first problem of the related-art technology, the change pattern of the time change rate of each working chamber volume with respect to the shaft rotation angle is changed and the total of the time change rate of each working chamber volume in each of the strokes of the suction and the discharge for each stroke is caused to approach a fixed value by devising the inner-circumferential-surface profile of the cam ring of the rotary-vane-type hydraulic pump and the hydraulic motor.

According to the means, it becomes possible to significantly reduce the fluctuation in the total of the time change rate of each working chamber volume in each stroke and cause the flow rate fluctuation of the hydraulic pump and the hydraulic motor to be minute even when the number of vanes is not increased.

In the means of the present invention for solving the second problem of the related-art technology, it becomes possible to form a rotor rotation angle interval that involves a fixed amount in which the volume of each working chamber that periodically changes becomes substantially fixed in a position in which the increasing and decreasing direction thereof changes by similarly devising the inner-circumferential-surface profile of the cam ring.

In the configuration of the means, it becomes possible to alleviate the pulse-like pressure pulsation and the exciting force because it becomes possible to take time to change the working chamber pressure to be the pressure on the new port side via the notch portion from the new port in the interval in which the volume is a predetermined amount that is substantially fixed. It also becomes possible to avoid the increase of the passage resistance of the flow of the working fluid liquid due to the volume change of the working chamber when a shape in which the communication passage area with the new port is promptly enlarged after the interval in which the volume is a predetermined amount that is substantially fixed is provided.

In this configuration, the communication with the port only needs to be blocked at the time point at which the working chamber volume has become substantially fixed, the communication between the new port and the working chamber only needs to be started via the notch portion during the interval in which the volume is a predetermined amount that is substantially fixed thereafter, and there is no need to cause two ports with different pressures to directly communicate with the working chambers at the same time. Therefore, it becomes possible to suppress the occurrence of leakage between the ports via the working chamber.

The inner-circumferential-surface profile of the cam ring in the means for solving the second problem also satisfies a configuration condition of the inner-circumferential-surface profile of the cam ring in the means for solving the first problem at the same time.

Advantageous Effects of Invention

First, according to the present invention, it becomes possible to cause the flow rate fluctuation as the hydraulic pump and the hydraulic motor to be minute until the flow rate fluctuation becomes zero, and hence it becomes possible to utilize the rotary-vane-type displacement machine as the constant volume pump. It becomes possible to significantly reduce the periodical pressure pulsation generated by the flow rate fluctuation and contribute to the reduction of the vibration and the noise of equipment. It becomes possible to realize the above without the adverse effects such as the decrease of efficiency due to the increase of the friction loss and the increase of cost.

Next, according to the present invention, it becomes possible to also reduce the pulse-like pressure pulsation generated at the timing of switching the communication between ports of the suction port and the discharge port and to contribute to further reduction of the vibration and the noise of the equipment. It becomes possible to also realize the improvement of the efficiency of the rotary-vane-type displacement machine by also reducing the leakage that occurs at the timing of switching the communication between the ports at the same time.

BRIEF DESCRIPTION OF DRAWINGS

FIG. 1 is a front view showing a related-art structure example of a rotary-vane-type hydraulic pump in which a cam ring profile is a perfect circle, five vanes are included, and each working chamber respectively performs one suction and one discharge during one rotation of a rotor.

FIG. 2 is a sectional side view showing a part configuration in the related-art structure example in FIG. 1.

FIG. 3 is a diagram showing a change of a front area of each working chamber in a suction stroke and a total area thereof in the related-art structure example of the rotary-vane-type hydraulic pump in FIG. 1 as functions of a rotor rotation angle.

FIG. 4 is a diagram showing a change of a front area of each working chamber in a discharge stroke and a total area thereof in the related-art structure example of the rotary-vane-type hydraulic pump in FIG. 1 as functions of a rotor rotation angle.

FIG. 5 is a diagram showing a pump flow-rate fluctuation pattern on the suction side of the related-art structure example that is a differential of the total area in FIG. 3 by the rotor rotation angle.

FIG. 6 is a diagram showing a pump flow-rate fluctuation pattern on the discharge side of the related-art structure example that is a differential of the total area in FIG. 4 by the rotor rotation angle.

FIG. 7 is a front view showing a structure example of a rotary-vane-type hydraulic pump that is a first structure example of Embodiment 1 of the present invention in which the five vanes and one suction and one discharge during one rotor rotation are in common with the related-art structure example in FIG. 1 but the cam ring profile is improved.

FIG. 8 is a diagram showing how the vanes move in accordance with the rotor rotation angle in order to define the improved cam ring profile in the first structure example of Embodiment 1.

FIG. 9 is a diagram showing a change of a front area of each working chamber in a suction stroke and a total area thereof in the first structure example in FIG. 7 as functions of a rotor rotation angle.

FIG. 10 is a diagram showing a change of a front area of each working chamber in a discharge stroke and a total volume thereof in the first structure example in FIG. 7 as functions of a rotor rotation angle.

FIG. 11 is a diagram showing a pump flow-rate fluctuation pattern on the suction side of the first structure example that is a differential of the total area in FIG. 9 by the rotor rotation angle.

FIG. 12 is a diagram showing a pump flow-rate fluctuation pattern on the discharge side of the first structure example that is a differential of the total area in FIG. 10 by the rotor rotation angle.

FIG. 13 is a view showing a front view of the cam ring profile, the rotor, each vane, a suction port, and a discharge port in a rotor rotation position in which the number of the suction working chambers is three and the number of the discharge working chambers is two in the first structure example in FIG. 7 and showing parts of the three suction working chambers and the two discharge working chambers seen from the front side with different hatchings.

FIG. 14 is a view showing a portion surrounded by two line segments connecting a rotor center and each of two contact points between the cam ring and frontmost and rearmost vanes out of all of the vanes forming the three suction working chambers in FIG. 13 to each other, a cam-ring inner circumferential surface, and a circular arc of a rotor outer diameter, and a portion surrounded by two line segments connecting the rotor center and each of two contact points between the cam ring and frontmost and rearmost vanes out of all the vanes forming the two discharge working chambers to each other, the cam-ring inner circumferential surface, and the circular arc of the rotor outer diameter with different hatchings.

FIG. 15 is a view showing each distal end portion of the vanes in the portion hatched on the suction working chamber side in FIG. 14 and similarly each distal end portion of the vanes in the hatched portion on the discharge working chamber side with different hatchings.

FIG. 16 is a view showing a front view of the cam ring profile, the rotor, each vane, the suction port, and the discharge port in another rotor rotation position in which the number of the suction working chambers is two and the number of the discharge working chambers is three in the first structure example in FIG. 7 and showing parts of the two suction working chambers and the three discharge working chambers seen from the front side with different hatchings.

FIG. 17 is a view showing a portion surrounded by two line segments connecting the rotor center and each of two contact points between the cam ring and frontmost and rearmost vanes out of all of the vanes forming the two suction working chambers in FIG. 16 to each other, the cam-ring inner circumferential surface, and the circular arc of the rotor outer diameter, and a portion surrounded by two line segments connecting the rotor center and each of two contact points between the cam ring and frontmost and rearmost vanes out of all the vanes forming the three discharge working chambers to each other, the cam-ring inner circumferential surface, and the circular arc of the rotor outer diameter with different hatchings.

FIG. 18 is a view showing each distal end portion of the vanes in the portion hatched on the suction working chamber side in FIG. 17 and similarly each distal end portion of the vanes in the hatched portion on the discharge working chamber side with different hatchings.

FIG. 19 is a diagram showing how vanes move in accordance with the rotor rotation angle in order to define a cam ring profile of a rotary-vane-type hydraulic pump that is a second structure example of Embodiment 1 of the present invention in which each working chamber performs a plurality of times of suction and discharge during one rotor rotation.

FIG. 20 is a front view showing a cam ring profile, a rotor, each vane, a suction port, and a discharge port of the second structure example of Embodiment 1.

FIG. 21 is a diagram showing a change of the front area of each working chamber that communicates with one suction port in the second structure example in FIG. 19 and the total area thereof as functions of the rotor rotation angle.

FIG. 22 is a diagram showing a pump flow-rate fluctuation pattern from one suction port of the second structure example that is the differential of the total area in FIG. 21 by the rotor rotation angle.

FIG. 23 is a diagram showing how vanes move in accordance with the rotor rotation angle in order to define a cam ring profile of a rotary-vane-type hydraulic pump that is a third structure example of Embodiment 1 of the present invention in which a circular arc portion of the cam ring profile is extended.

FIG. 24 is a front view showing a cam ring profile, a rotor, each vane, a suction port, and a discharge port of the third structure example of Embodiment 1.

FIG. 25 is a diagram showing how vanes move in accordance with the rotation angle in order to define a cam ring profile of a rotary-vane-type hydraulic pump that is a structure example of Embodiment 2 of the present invention.

FIG. 26 is a front view showing a cam ring profile, a rotor, each vane, a suction port, and a discharge port of the structure example of Embodiment 2.

FIG. 27 is a diagram showing a change of a front area of each working chamber in a suction stroke and a total area thereof in the structure example of Embodiment 2 in FIG. 26 as functions of the rotor rotation angle.

FIG. 28 is a diagram showing a pump flow-rate fluctuation pattern on the suction side of the structure example of Embodiment 2 that is a differential of the total area in FIG. 27 by the rotor rotation angle.

FIG. 29 is a diagram for describing the reason the flow rate fluctuation becomes zero by the general structure of Embodiment 2.

FIG. 30 is a diagram showing how vanes move in accordance with the rotation angle in order to define a cam ring profile of a rotary-vane-type hydraulic pump that is a structure example of Embodiment 3 of the present invention.

FIG. 31 is a front view showing a cam ring profile, a rotor, each vane, a suction port, and a discharge port of the structure example of Embodiment 3.

FIG. 32 is a diagram showing a change of a front area of each working chamber in a suction stroke and a total area thereof in the structure example of Embodiment 3 in FIG. 31.

FIG. 33 is a diagram showing a pump flow-rate fluctuation pattern on the suction side of the structure example of Embodiment 3 that is a differential value of the total area in FIG. 32 by the rotor rotation angle.

FIG. 34 is a diagram showing how the vane position changes in accordance with the rotor rotation angle in order to define a cam ring profile different from the cam ring profile of the rotary-vane-type hydraulic pump of the present invention.

FIG. 35 is a diagram obtained by curves expressing the change in the vane position with respect to the rotor rotation angle in FIG. 34 by the rotor rotation angle.

FIG. 36 is a diagram obtained by differentiating the curves expressing the change in the vane position with respect to the rotor rotation angle in FIG. 30 by the rotor rotation angle.

FIG. 37 is a diagram showing how a radial-direction distance of a point on the profile from the rotor center changes in accordance with a deflection angle with respect to an X-axis in order to directly define a cam ring inner-circumference profile that causes the movement of the vanes in FIG. 30.

FIG. 38 is a diagram obtained by differentiating the curves expressing the change in the radial-direction distance with respect to the deflection angle in FIG. 37 by the deflection angle.

DESCRIPTION OF EMBODIMENTS

Next, forms for carrying out the present invention are described with use of several embodiments.

Embodiment 1

A structure of a rotary-vane-type hydraulic pump that is Embodiment 1 of the present invention is shown below by FIG. 7 to FIG. 24. FIG. 7 to FIG. 12 are diagrams describing a first structure example of Embodiment 1 and showing a result in which the flow rate fluctuation becomes zero. FIG. 13 to FIG. 18 are views used to describe the reason the flow rate fluctuation in the first structure example of Embodiment 1 becomes zero, FIG. 19 to FIG. 22 are diagrams and views showing a second structure example of Embodiment 1, FIG. 23 and FIG. 24 are a diagram and view showing a third structure example of Embodiment 1.

FIG. 7 is a front view showing a structure example of a rotary-vane-type hydraulic pump that is a first structure example of Embodiment 1 of the present invention in which five vanes and one suction and one discharge during one rotor rotation are in common with the related-art structure example in FIG. 1 but a cam ring profile is improved. FIG. 8 is a diagram showing how the vanes move in accordance with the rotor rotation angle in order to define the improved cam ring profile in the first structure example. FIG. 9 is a diagram showing a change of a front area of each working chamber in a suction stroke and a total area thereof in the first structure example in FIG. 7. FIG. 10 is a diagram showing a change of a front area of each working chamber in a discharge stroke and a total volume thereof in the first structure example in FIG. 7 as functions of a rotor rotation angle. FIG. 11 is a diagram showing a pump flow-rate fluctuation pattern on the suction side of the first structure example that is a differential value of the total area in FIG. 9 by the rotor rotation angle. FIG. 12 is a diagram showing a pump flow-rate fluctuation pattern on the discharge side of the first structure example that is a differential value of the total area in FIG. 10 by the rotor rotation angle.

FIG. 13 is a view showing a front view of the cam ring profile, the rotor, each vane, a suction port, and a discharge port in a rotor rotation position in which the number of the suction working chambers is three and the number of the discharge working chambers is two in the first structure example in FIG. 7 and showing parts of the three suction working chambers and the two discharge working chambers seen from the front side with different hatchings. FIG. 14 is a view showing a portion surrounded by two line segments connecting a rotor center and each of two contact points between the cam ring and frontmost and rearmost vanes out of all of the vanes forming the three suction working chambers in FIG. 13 to each other, a cam-ring inner circumferential surface, and a circular arc of a rotor outer diameter, and a portion surrounded by two line segments connecting the rotor center and each of two contact points between the cam ring and frontmost and rearmost vanes out of all the vanes forming the two discharge working chambers to each other, the cam-ring inner circumferential surface, and the circular arc of the rotor outer diameter with different hatchings. FIG. 15 is a view showing each distal end portion of the vanes in the portion hatched on the suction working chamber side in FIG. 14 and similarly each distal end portion of the vanes in the hatched portion on the discharge working chamber side with different hatchings.

FIG. 16 is a view showing a front view of the cam ring profile, the rotor, each vane, the suction port, and the discharge port in another rotor rotation position in which the number of the suction working chambers is two and the number of the discharge working chambers is three in the first structure example in FIG. 7 and showing parts of the two suction working chambers and the three discharge working chambers seen from the front side with different hatchings. FIG. 17 is a view showing a portion surrounded by two line segments connecting the rotor center and each of two contact points between the cam ring and frontmost and rearmost vanes out of all of the vanes forming the two suction working chambers in FIG. 16 to each other, the cam-ring inner circumferential surface, and the circular arc of the rotor outer diameter, and a portion surrounded by two line segments connecting the rotor center and each of two contact points between the cam ring and frontmost and rearmost vanes out of all the vanes forming the three discharge working chambers to each other, the cam-ring inner circumferential surface, and the circular arc of the rotor outer diameter with different hatchings. FIG. 18 is a view showing each distal end portion of the vanes in the portion hatched on the suction working chamber side in FIG. 17 and similarly each distal end portion of the vanes in the hatched portion on the discharge working chamber side with different hatchings.

FIG. 19 is a diagram showing how vanes move in accordance with the rotor rotation angle in order to define a cam ring profile of a rotary-vane-type hydraulic pump that is a second structure example of Embodiment 1 of the present invention in which each working chamber performs a plurality of times of suction and discharge during one rotor rotation. FIG. 20 is a front view showing a cam ring profile, a rotor, each vane, a suction port, and a discharge port of the second structure example of Embodiment 1. FIG. 21 is a diagram showing a change of the front area of each working chamber that communicates with one suction port in the second structure example in FIG. 19 and the total area thereof as functions of the rotor rotation angle. FIG. 22 is a diagram showing a pump flow-rate fluctuation pattern from one suction port of the second structure example that is the differential value of the total volume in FIG. 21 by the rotor rotation angle.

FIG. 23 is a diagram showing how the vanes move in accordance with the rotor rotation angle in order to define a cam ring profile of a rotary-vane-type hydraulic pump that is a third structure example of Embodiment 1 of the present invention in which a circular arc interval of the cam ring profile is expanded. FIG. 24 is a front view showing a cam ring profile, a rotor, each vane, a suction port, and a discharge port of the third structure example of Embodiment 1.

In FIG. 7 that is the first structure example of Embodiment 1, as with the related-art structure example in FIG. 1, a shaft member 11, a rotor 12, five vanes 13, a cam ring 14, and two side plates 15, 16 are shown as main components. The vanes 13 also perform one advance and retreat movement within rotor slits 12*a* for one rotation of the rotor 12 while distal ends thereof are pressed against a cam-ring inner circumferential surface 14*a*.

Meanwhile, the profile of the cam-ring inner circumferential surface 14*a* is different from the related-art structure example in FIG. 1 and the entirety is not one perfect circle. In the first structure example in FIG. 7, the sectional shape of the distal end of the vane 13 is a circular arc with a small radius $R_v$, and a circular arc center point $P_0$ thereof is a fixed point on the vane and is on a line offset from the center of the rotor 12 to the opposite rotation side in a direction orthogonal to the direction of the rotor slit 12*a* by $O_f$. At this time, the profile of the cam-ring inner circumferential surface 14*a* can be defined by showing how a direction distance L of the point $P_0$ from the rotor center O in the rotor slit 12*a* direction changes when the shaft member 11 and the rotor 12 are rotated in a state in which the distal end of the vane 13 maintains a contact with the cam-ring inner circumferential surface 14*a*.

FIG. 8 shows L described above as a function $L(\theta_r)$ of a rotor rotation angle $\theta_r$. Regarding the rotor rotation angle $\theta_r$, the rotor position when one of the rotor slits 12*a* becomes parallel to an X-axis in FIG. 7 and opens to an outer circumference surface in the X-axis positive direction serves as a reference, and $\theta_r=0$ is established in that position. Here, $L(\theta_r)$ represents the distance L described above of the vane 13 in the rotor slit 12*a* rotated from the reference position in the counterclockwise direction in FIG. 7 by $\theta_r$.

In FIG. 8, an example of a curve of $L(\theta_r)$ in the first structure example of Embodiment 1 is expressed by an interval of $0\leq\theta_r\leq 2\pi$. This interval is formed by a first interval that is fixed at a minimum value $L_{min}$, a second interval that is an increasing interval to a maximum value $L_{max}$, a third interval that is fixed at the maximum value $L_{max}$, a fourth interval that is a decreasing interval to the minimum value $L_{min}$, and a fifth interval that is fixed at the minimum value $L_{min}$ again. Those intervals are smoothly connected to each other and indicate that the vane 13 performs the advance and retreat movement with a period of one rotation of the rotor. A change amount of $\theta_r$ in each of the intervals from the first interval to the fifth interval is expressed by symbols $\theta_1$, $\theta_2$, $\theta_3$, $\theta_4$, and $\theta_5$, where $\theta_1=\pi/5)$ (36°, $\theta_2=3\pi/5$ (108°), $\theta_3=2\pi/5$ (72°), $\theta_4=3\pi/5$ (108°), $\theta_5=\pi/5)$ (36°, and $L_{min}=21$ mm, $L_{max}=26$ mm are satisfied in this structure example. As with the related-art structure example in FIG. 1, a rotor diameter $D_r=46$ mm, the number of vanes $N_v=5$, a vane distal-end circular-arc radius $R_v=3$ mm, a distal-end circular-arc-center offset $O_f=2$ mm, and a vane thickness T=1.6 mm are satisfied in this structure example as well.

In FIG. 8, $L(\theta_r)$ in the first interval of $0\leq\theta_r\leq\theta_1$, $L(\theta_r)$ in the third interval of $\theta_1+\theta_2\theta_r<\theta_1+\theta_2+\theta_3$, and $L(\theta_r)$ in the fifth interval of $\theta_1+\theta_2+\theta_3+\theta_4\leq\theta_r<2\pi$ are given as fixed values of Expression (1), Expression (2), and Expression (3), respectively.

[Expression 1]

$$L(\theta_r)=L_{min} \tag{1}$$

in the first interval $0\leq\theta_r<\theta_1$

[Expression 2]

$$L(\theta_r)=L_{max} \tag{2}$$

in the third interval $\theta_1+\theta_2\leq\theta_r<\theta_1+\theta_2+\theta_3$

[Expression 3]

$$L(\theta_r)=L_{min} \tag{3}$$

in the fifth interval $\theta_1+\theta_2+\theta_3+\theta_4\leq\theta_r<2\pi$

Profile intervals in which the vanes 43 perform a radial-direction movement in the rotor outer circumferential direction or the inner circumferential direction in accordance with the rotation of the rotor such as the second interval of $\theta_1\leq\theta'<\theta_1+\theta_2$ and the fourth interval of $\theta_1+\theta_2+\theta_3\leq\theta_r<\theta_1+\theta_2+\theta_3+\theta_4$ in FIG. 8 are further divided into a first portion, a second portion, and a third portion continuously connected in order, and $L(\theta_r)$ in each portion is given by a functional form different from each other. The $L(\theta_r)$ obtained by connecting them has smooth connections to $L(\theta_r)$ in the first interval, $L(\theta_r)$ in the third interval, and $L(\theta_r)$ in the fifth interval as a result of a gradient $dL/d\theta_r$ being zero at a starting end of the first portion and a terminal end of the third portion; and $L(\theta_r)$ in each portion is smoothly connected to each other as a result of the gradient $dL/d\theta_r$ being the same values at a terminal end of the first portion and a starting end of the third portion and the gradient of the second portion being a fixed value equal to those same values.

In the second interval in FIG. 8, a change amount of $\theta_r$ in a first portion is represented by $\gamma_1$, a change amount of $\theta_r$ in a second portion is represented by $\gamma_2$, a change amount of $\theta_r$ in a third portion is represented by $\gamma_3$, and $\gamma_3$ and $\gamma_1$ are equal to each other. As combination examples of a functional form of $L(\theta_r)$ in which a smooth connection described above is realized, a combination of Expression (4) in the first portion, Expression (5) in the second portion, and Expression (6) in the third portion is conceived. As combination examples of a functional form of $L(\theta_r)$ in which a smooth connection described above is realized, a combination of Expression (7) in the first portion, Expression (8) in the second portion, and Expression (9) in the third portion is conceived in the fourth interval as well when the change amount of $\theta_r$ in the first portion is represented by $\gamma_1$, the change amount of $\theta_r$ in the second portion is represented by 12, the change amount of $\theta_r$ in the third portion is represented by $\gamma_3$, and $\gamma_3$ is equal to $\gamma_1$. In the first structure example, the number of vanes $N_v=5$ is satisfied, and hence an angle $\alpha=2\pi/N_v=2\pi/5$ (72°) between adjacent rotor slits is satisfied, $\gamma_1$ and $\gamma_3$ satisfy $\gamma_1=\gamma_3=\pi/5$ (36°) in both of the second interval and the fourth interval, $\gamma_2$ satisfies $\gamma_2=\alpha-\gamma_1$, and $\gamma_2$ satisfies $\gamma_2=\pi/5$ (36°) in both of the second interval and the fourth interval.

[Expression 4]

$$L(\theta_r)=\frac{L_{max}-L_{min}}{2(\gamma_1+\gamma_2)}\cdot(\theta_r-\theta_1)-\frac{L_{max}-L_{min}}{2(\gamma_1+\gamma_2)}\cdot\frac{\gamma_1}{2}\cdot\sin\left(2\pi\frac{\theta_r-\theta_1}{2\gamma_1}\right)+L_{min} \quad (4)$$

in the first portion $\theta_1\leq\theta_r>\theta_1+\gamma_1$ in the second interval

[Expression 5]

$$L(\theta_r)=\frac{L_{max}-L_{min}}{2(\gamma_1+\gamma_2)}\cdot(\theta_r-\theta_1)-\frac{L_{max}-L_{min}}{2(\gamma_1+\gamma_2)}\cdot\gamma_1+L_{min} \quad (5)$$

in the second portion $\theta_1+\gamma_1\leq\theta_r<\theta_1+\gamma_1+\gamma_2$ in the second interval

[Expression 6]

$$L(\theta_r)=\frac{L_{max}-L_{min}}{2(\gamma_1+\gamma_2)}\cdot(\theta_r-\theta_1)-\frac{L_{max}-L_{min}}{2(\gamma_1+\gamma_2)}\cdot\frac{\gamma_1}{2}\cdot\sin\left(2\pi\frac{\theta_r-\theta_1-\gamma_2}{2\gamma_1}\right)+\frac{L_{max}-L_{min}}{2(\gamma_1+\gamma_2)}\cdot\gamma_2+L_{min} \quad (6)$$

in the third portion $\theta_1+\gamma_1+\gamma_2\leq\theta_1+\gamma_2\gamma_1+\gamma_2$ in the second interval

[Expression 7]

$$L(\theta_r)=-\frac{L_{max}-L_{min}}{2(\gamma_1+\gamma_2)}\cdot(\theta_r-\theta_1-\theta_2-\theta_3)+\frac{L_{max}-L_{min}}{2(\gamma_1+\gamma_2)}\cdot\frac{\gamma_1}{\pi}\cdot\sin\left(2\pi\frac{\theta_r-\theta_1-\theta_2-\theta_3}{2\gamma_1}\right)+L_{max} \quad (7)$$

in the first portion $\theta_1+\theta_2+\theta_3\leq\theta_r<\theta_1+\theta_2+\theta_3+\gamma_1$ in the fourth interval

[Expression 8]

$$L(\theta_r)=-\frac{L_{max}-L_{min}}{2(\gamma_1+\gamma_2)}\cdot(\theta_r-\theta_1-\theta_2-\theta_3)+\frac{L_{max}-L_{min}}{2(\gamma_1+\gamma_2)}\cdot\gamma_1+L_{max} \quad (8)$$

in the second portion $\theta_1+\theta_2+\theta_3+\gamma_1\leq\theta_r<\theta_1+\theta_2+\theta_3+\gamma_1+\gamma_2$ in the fourth interval

[Expression 9]

$$L(\theta_r)=-\frac{L_{max}-L_{min}}{2(\gamma_1+\gamma_2)}\cdot(\theta_r-\theta_1-\theta_2-\theta_3)+\frac{L_{max}-L_{min}}{2(\gamma_1+\gamma_2)}\cdot\frac{\gamma_1}{\pi}\cdot\sin\left(2\pi\frac{\theta_r-\theta_1-\theta_2-\theta_3-\gamma_2}{2\gamma_1}\right)-\frac{L_{max}-L_{min}}{2(\gamma_1+\gamma_2)}\cdot\gamma_2+L_{max} \quad (9)$$

in the third portion $\theta_1+\theta_2+\theta_3+\gamma_1+\gamma_2\leq\theta_r<\theta_1+\theta_2+\theta_3+\gamma 2_1+\gamma_2$ in the fourth interval The actual profile of the cam-ring inner circumferential surface 14*a* defined by $L(\theta_r)$ is shown in FIG. 7 and FIG. 13 to FIG. 16, a contact point of the distal end of the vane 13 in a boundary position of the intervals and the portions of $\theta_r$ in FIG. 8 is shown on the line thereof by a black point $P_{i-j}$ or $P_{k-l-m}$. Here, $P_{i-j}$ represents a contact point in a boundary between an i-th interval and a j-th interval of $\theta_r$, and $P_{k-l-m}$ represents a contact point in a boundary between a l-th portion and an m-th portion in a k-th interval of $\theta_r$. This also applies to explanatory diagrams and views of other embodiments and structure examples. The first interval and the fifth interval correspond to circular arc portions with a relatively small radius having a common center with the rotor 42, and the third interval corresponds to a circular arc portion with a relatively great radius. Each the second interval and the fourth interval correspond to an interval in which the distance from the rotor center increases and an interval in which the distance from the rotor center decreases in order to smoothly connect the great and small circular arc portions. The actual profile of the cam-ring inner circumferential surface 14*a* is not a trajectory of the vane distal-end circular-arc center point $P_0$ directly obtained from $L(\theta_r)$ and is an envelope on the outer side of a group of circles of which center is on the trajectory and which have the radius $R_v$.

A calculation result of the front area S of each working chamber in the suction stroke in the first structure example having this profile of the cam-ring inner circumferential surface is shown in FIG. 9, and a calculation result of the front area S of each working chamber in the discharge stroke is shown in FIG. 10 as functions of the rotor rotation angle $\theta_r$. As it can be understood from FIG. 7, one working chamber area increases and decreases once during one rotation in accordance with the change of the rotor rotation angle $\theta_r$, the suction port is formed in a position that communicates with the working chamber in the interval of $\theta_r$ in which the distance $L(\theta_r)$ of each vane forming the working chamber from the rotor center starts to increase by the front vane and ends to increase by the rear vane, and the discharge port is formed in a position that communicates with the working chamber in the interval of $\theta_r$ in which the distance $L(\theta_r)$ of each vane forming the working chamber from the rotor center starts to decrease by the front vane and ends to decrease by the rear vane. The working chamber that communicates with the suction port is the working chamber in the suction stroke, and the working chamber that communicates with the discharge port is the working chamber in the discharge stroke.

One working chamber area S in the suction stroke in FIG. 9 is equivalent to an increasing portion of the increase and decrease of the working chamber area. One working chamber area S in the discharge stroke in FIG. 10 is equivalent to a decreasing portion of the increase and decrease of the working chamber area. In the structure example of Embodiment 1, the number of the vanes 13 $N_v=5$ is satisfied, and hence there are always five working chambers of which phases are shifted from each other by the angle $\alpha=2\pi/5$ (72°) between the adjacent rotor slits. The calculation results of all of the working chamber areas S are all shown in FIG. 9 and FIG. 10.

In each of FIG. 9 and FIG. 10, a calculation result of a total area $S_t(\theta_r)$ of a working chamber area $S(\theta_r)$ of each stroke in the position of $\theta_r$ that is the horizontal axis is also shown. The number of the vanes 13 $N_v=5$ is satisfied in the first structure example of Embodiment 1. Therefore, in both of the drawings, there is a case where the number of the working chambers in each stroke is three and a case where the number of the working chambers in each stroke is two at one position of $\theta_r$, and those areas $S(\theta_r)$ are indicated by $S_1$ to $S_3$ or $S_1$ to $S_2$ in the drawings. The total area $S_t(\theta_r)$ thereof changes in a stepwise manner at positions at which the number is switched, but change is made at a substantially fixed gradient in each interval in which the number is fixed. The change in the stepwise manner of the former is due to the starting and ending of communication between one working chamber and each port and is not a change of the working chamber total area $S_t(\theta_r)$ in a state of communicating with each port. Therefore, the total volume obtained by multiplying $S_t(\theta_r)$ by the thickness W of the cam ring that is the fixed value does not change in a state of communicating with each port, and the fluctuation of the pump flow rate is not affected on the suction side nor the discharge side. Meanwhile, in an interval in which $S_t(\theta_r)$ changes at a substantially fixed gradient, the volume of the working chamber that communicates with each port changes when the gradient is multiplied by a fixed value W. Therefore, the change of the gradient shows a change pattern of the pump flow rate (volume change amount per unit time).

FIG. 11 and FIG. 12 show calculation results of $dS_t/d\theta_r$ obtained by differentiating the total area $S_t(\theta_r)$ in FIG. 9 and FIG. 10, respectively, by $\theta_r$. When the above is multiplied by each of the fixed values of an angular velocity $\omega$ and the thickness W of the cam ring, a calculation value obtained by differentiating the total volume by time t is obtained. Therefore, the calculation results in FIG. 11 and FIG. 12 indicate the fluctuation of the pump flow rate pattern on the suction side and the discharge side. Every calculation result of $dS_t/d\theta_r$ is a perfect fixed value in the entire range of the rotor rotation angle $\theta_r$, and it can be understood that it is possible to cause the pump flow rate fluctuation to be zero on both the suction side and the discharge side in the first structure example of Embodiment 1.

In the rotary-vane-type hydraulic pump of the present invention, a first configuration condition for causing the pump flow rate fluctuation to be zero as in FIG. 11 and FIG. 12 is expressed by Expression (10). This means that an angle interval $\beta$ of $\theta_r$ in which $L(\theta_r)$ becomes a fixed value is not smaller than the angle $\alpha$ between the rotor slits. In the first structure example of Embodiment 1, $\alpha=2\pi/5$ (72°), $\beta=\theta_1+\theta_5=\theta_3=2\pi/5$ (72°) are satisfied as described above, and hence the first configuration condition of Expression (10) is satisfied.

[Expression 10]

$$\beta \geq \alpha \tag{10}$$

Similarly, a second configuration condition for causing the pump flow rate fluctuation to become zero in the present invention is expressed by Expression (11). This is a conditional expression in which the left-hand side is an angle obtained by subtracting the angle $\gamma_2$ of the second portion in which $dL/d\theta_r$ is fixed from an angle $\gamma$ that is $\theta_2$, $\theta_4$, or the like that is a profile interval in which the vanes perform the radial-direction movement in accordance with the rotation of the rotor, and the angle is n times of an angle in the brackets on the right-hand side obtained by subtracting the angle $\gamma_2$ of the second portion interval from an angle $\alpha'$ between the rotor slits of two vanes sandwiching the second portion. Here, n represents an integer of 2 or more.

[Expression 11]

$$\gamma-\gamma_2=n\times(\alpha'-\gamma_2) \tag{11}$$

In the first structure example of Embodiment 1, there are two vanes sandwiching each of the second portions on the suction side in the rotation position of the rotor 12 in FIG. 7 and FIG. 13 and the discharge side in the rotation position of the rotor 12 in FIG. 16. However, $\alpha$ is greater than $\gamma_2$ as described above, and hence $\alpha'=\alpha=2\pi/5$ (72°) is satisfied. In addition, $\gamma_1=\pi/5$) (36°) is satisfied and $\gamma_2=\pi/5$ (36°) is satisfied. Therefore, $\gamma=2\gamma_1+\gamma_2=3\pi/5$ (108°) is satisfied. Expression (11) is satisfied at the time of n=2, and hence the second configuration condition is satisfied. The second configuration condition in Embodiment 1 is rewritten to Expression (12) by assigning n=2, $\alpha'=\alpha$, $\gamma=2\gamma_1+\gamma_2$ to Expression (11).

[Expression 12]

$$\gamma_1+\gamma_2=\alpha \tag{12}$$

Next, the reason it becomes possible to cause the pump flow rate fluctuation on the suction side to be zero by satisfying the first configuration condition and the second configuration condition and giving the motion of the vanes 13 by Expression (4) to Expression (9) in the first structure example of Embodiment 1 is described first with reference to FIG. 13 to FIG. 18. When the number of the working chambers in the suction stroke is three as in FIG. 13, a total volume $V_{st}(\theta_r)$ of each working chamber is expressed by Expression (13) with use of areas $S_{s1}(\theta_r)$, $S_{s2}(\theta_r)$, $S_{s3}(\theta_r)$ of each working chamber shown in FIG. 13 and the cam ring thickness W. Next, the right-hand side in Expression (13) is rewritten as in Expression (14) with use of $S_{s0}(\theta_r)$ in FIG. 14 and $S_{sv1}(\theta_r)$, $S_{sv2}(\theta_r)$, $S_{sv3}(\theta_r)$, $S_{sv4}(\theta_r)$ in FIG. 15.

[Expression 13]

$$V_{st}(\theta_r)=W\times(S_{s1}(\theta_r)+S_{s2}(\theta_r)+S_{s3}(\theta_r)) \tag{13}$$

[Expression 14]

$$V_{st}(\theta_r)=W\times(S_{s0}(\theta_r)-S_{sv1}(\theta_r)-S_{sv2}(\theta_r)-S_{sv3}(\theta_r)-S_{sv4}(\theta_r)) \tag{14}$$

Next, a pump flow rate $Q_s(t)$ on the suction side is first expressed by Expression (15) as a time change rate of $V_{st}(\theta_r)$. Then, the relationship of Expression (16) derived from $\theta_r=\omega t$ by setting the rotation speed of the rotor to be the fixed value $\omega$ (rad/s) is assigned, and the pump flow rate $Q_s(t)$ is expressed by Expression (17) in the end.

[Expression 15]

$$Q_s(t) = W \cdot \left\{ \frac{dS_{s0}}{dt} - \frac{dS_{sv1}}{dt} - \frac{dS_{sv2}}{dt} - \frac{dS_{sv3}}{dt} - \frac{dS_{sv4}}{st} \right\} \tag{15}$$

[Expression 16]

$$dt = \frac{1}{\omega} d\theta_r \tag{16}$$

[Expression 17]

$$Q_s(t) = W \cdot \omega \cdot \left\{ \frac{dS_{s0}}{dt} - \frac{dS_{sv1}}{dt} - \frac{dS_{sv2}}{dt} - \frac{dS_{sv3}}{dt} - \frac{dS_{sv4}}{st} \right\} \tag{17}$$

As described above, in the first structure example of Embodiment 1, the first configuration condition of $\beta \leq \alpha$ of Expression (10) is satisfied. Therefore, the front vane forming the area $S_{s0}(\theta_r)$ in FIG. 14 is always in the state of jutting out from the slits the most in Expression (2), and the rear vane is always in the state of being pulled into the slits the most in Expression (1) or Expression (3) and remaining still in the slits. Therefore, lengths $R_{max}$ and $R_{min}$ of line segments connecting the center of the rotor 12 and each of two contact points between those vanes and the cam-ring inner circumferential surface 14*a* to each other become fixed values, and Expression (19) is derived after the relational expression of Expression (18) is derived first where the rotor outer circumference radius is represented by $R_r$. It can be understood that a first term on the right-hand side in the curly brackets in Expression (17) is a fixed value in accordance with Expression (19) in the end. When the vane distal end is a circular arc having the radius $R_v$ and the center $P_0$ is offset from the center of the rotor 12 to the opposite rotation side in a direction orthogonal to the direction of the rotor slit 12*a* by $O_f$ as in the first structure example, $R_{max}$ and $R_{min}$ are fixed values calculated by Expression (20) and Expression (21), respectively.

[Expression 18]

$$dS_{s0} = \frac{R_{max}^2}{2} d\theta_r - \frac{R_r^2}{2} d\theta_r - \left( \frac{R_{min}^2}{2} d\theta_r - \frac{R_r^2}{2} d\theta_r \right) \tag{18}$$

[Expression 19]

$$\frac{dS_{s0}}{d\theta_r} = \frac{R_{max}^2 - R_{min}^2}{2} \tag{19}$$

[Expression 20]

$$R_{max} = \sqrt{L_{max}^2 + O_f^2} + R_v \tag{20}$$

[Expression 21]

$$R_{min} = \sqrt{L_{min}^2 + O_f^2} + R_v \tag{21}$$

In the first structure example, the first configuration condition of $\beta \leq \alpha$ of Expression (10) is satisfied and a front vane and a rear vane forming $S_{s0}(\theta_r)$ are both remaining still in the slits, and hence the areas of those vane distal end portions do not change in accordance with $\theta_r$. From the above, regarding a second term and a fifth term within the curly brackets on the right-hand side in Expression (17), Expression (22) is satisfied, and both become fixed values of zero.

[Expression 22]

$$-\frac{dS_{sv1}}{d\theta_r} = -\frac{dS_{sv4}}{d\theta_r} = 0 \tag{22}$$

Here, Expression (4) to Expression (9) are rewritten as below with use of the rotation angle $\theta$ of the rotor based on starting ends of the second interval and the fourth interval. First, in the second interval of the first structure example, the relationship of Expression (23) and the relationship of Expression (12) are assigned to Expression (4) to Expression (6), and Expression (24) is obtained in the first portion, Expression (25) is obtained in the second portion, and Expression (26) is obtained in the third portion. Similarly, in the fourth interval of the first structure example, the relationship of Expression (27) and the relationship of Expression (12) are assigned to Expression (7) to Expression (9), and Expression (28) is obtained in the first portion, Expression (29) is obtained in the second portion, and Expression (30) is obtained in the third portion.

[Expression 23]

$$\dot{\theta}_r - \dot{\theta}_1 = \dot{\theta} \tag{23}$$

[Expression 24]

$$L(\theta) = \frac{L_{max} - L_{min}}{2\alpha} \cdot \theta - \frac{L_{max} - L_{min}}{2\alpha} \cdot \frac{\gamma_1}{\pi} \cdot \sin\left(2\pi \frac{\theta}{2\gamma_1}\right) + L_{min} \tag{24}$$

in the first portion $0 \leq \theta < \gamma_1$ in the second interval

[Expression 25]

$$L(\theta) = \frac{L_{max} - L_{min}}{2\alpha} \cdot \theta - \frac{L_{max} - L_{min}}{2\alpha} \cdot \gamma_1 + L_{min} \tag{25}$$

in the second portion $\gamma_1 \leq \theta < \gamma_1 + \gamma_2$ in the second interval

[Expression 26]

$$L(\theta) = \frac{L_{max} - L_{min}}{2\alpha} \cdot \theta - \frac{L_{max} - L_{min}}{2\alpha} \cdot \frac{\gamma_1}{\pi} \cdot \sin\left(2\pi \frac{\theta - \alpha + \gamma_1}{2\gamma_1}\right) + \frac{L_{max} - L_{min}}{2\alpha} \cdot (\alpha - \gamma_1) + L_{min} \tag{26}$$

in the third portion $\gamma_1 + \gamma_2 \leq \theta < 2\gamma_1 + \gamma_2$ in the second interval

[Expression 27]

$$\dot{\theta}_r - \dot{\theta}_1 - \dot{\theta}_2 - \dot{\theta}_3 = \dot{\theta} \tag{27}$$

[Expression 28]

$$L(\theta) = -\frac{L_{max} - L_{min}}{2\alpha} \cdot \theta + \frac{L_{max} - L_{min}}{2\alpha} \cdot \frac{\gamma_1}{\pi} \cdot \sin\left(2\pi \frac{\theta}{2\gamma_1}\right) + L_{max} \tag{28}$$

in the first portion $0 \leq \theta < \gamma_1$ in the fourth interval

[Expression 29]

$$L(\theta) = -\frac{L_{max} - L_{min}}{2\alpha} \cdot \theta + \frac{L_{max} - L_{min}}{2\alpha} \cdot \gamma_1 + L_{max} \tag{29}$$

in the second portion $\gamma_1 \leq \theta < \gamma_1 + \gamma_2$ in the fourth interval

[Equation 30]

$$L(\theta) = -\frac{L_{max} - L_{min}}{2\alpha} \cdot \theta + \frac{L_{max} - L_{min}}{2\alpha} \cdot \frac{\gamma_1}{\pi} \cdot \sin\left(2\pi \frac{\theta - \alpha + \gamma_1}{2\gamma_1}\right) - \frac{L_{max} - L_{min}}{2\alpha} \cdot (\alpha - \gamma_1) + L_{max} \quad (30)$$

in the third portion $\gamma_1+\gamma_2 \leq \theta < 2\gamma_1+\gamma_2$ in the fourth interval Two vanes having distal end areas of $S_{av2}(\theta_r)$ and $S_{sv3}(\theta_r)$ are in the first portion and the third portion, and hence a third term and a fourth term within the curly brackets on the right-hand side in Expression (17) are respectively calculated by Expression (31) and Expression (32) by giving the positions $L(\theta)$ in the slits of the vanes by Expression (24) and Expression (26), performing differentiation by $\theta$, and performing multiplication by the vane thickness T, and the total thereof becomes a fixed value of Expression (33).

[Expression 31]

$$-\frac{dS_{sv2}}{d\theta_r} = -T \cdot \frac{dL(\theta_r)}{d\theta_r} = -T \cdot \frac{dL(\theta)}{d\theta} = -T \cdot \frac{L_{max} - L_{min}}{2\alpha} + T \cdot \frac{L_{max} - L_{min}}{2\alpha} \cdot \cos\left(2\pi \frac{\theta}{2\gamma_1}\right) \quad (31)$$

[Expression 32]

$$-\frac{dS_{sv3}}{d\theta_r} = -T \cdot \frac{dL(\theta_r + \alpha)}{d\theta_r} = -T \cdot \frac{dL(\theta + \alpha)}{d\theta} = -T \cdot \frac{L_{max} - L_{min}}{2\alpha} + T \cdot \cdot \cos\left(2\pi \frac{\theta + \alpha - \alpha + \gamma_1}{2\gamma_1}\right) = -T \cdot \frac{L_{max} - L_{min}}{2\alpha} + T \cdot \frac{L_{max} - L_{min}}{2\alpha} \cdot \cos\left(2\pi \frac{\theta}{2\gamma_1} + \pi\right) \quad (32)$$

[Expression 33]

$$-\frac{dS_{sv2}}{d\theta_r} - \frac{dS_{sv3}}{d\theta_r} = -T \cdot \frac{L_{max} - L_{min}}{\alpha} \quad (33)$$

It has been able to be proved that the suction-side pump flow rate $Q_s(t)$ becomes a fixed value on the right-hand side in Expression (34) when Expression (19), Expression (22), and Expression (33) are assigned to Expression (17) when the number of the working chambers in the suction stroke is three in the first structure example of Embodiment 1.

[Expression 34]

$$Q_s(t) = W \cdot \omega \cdot \left(\frac{R_{max}^2 - R_{min}^2}{2} - T \cdot \frac{L_{max} - L_{min}}{\alpha}\right) \quad (34)$$

When the number of the suction working chambers is two as in FIG. 16, a total volume $V_{st}(\theta_r)$ of each working chamber volume is expressed by Expression (35) with use of areas $S_{s1}(\theta_r)$, $S_{s2}(\theta_r)$ of each working chamber shown in FIG. 16 and the cam ring thickness W. The right-hand side in Expression (35) is rewritten as in Expression (36) with use of $S_{s0}(\theta_r)$ in FIG. 17 and $S_{sv1}(\theta_r)$, $S_{sv2}(\theta_r)$, $S_{sv3}(\theta_r)$ in FIG. 18.

[Expression 35]

$$V_{st}(\theta_r) = W \times (S_{s1}(\theta_r) + S_{s2}(\theta_r)) \quad (35)$$

[Expression 36]

$$V_{st}(\theta_r) = W \times (S_{s0}(\theta_r) - S_{sv1}(\theta_r) - S_{sv2}(\theta_r) - S_{sv3}(\theta_r) \quad (36)$$

The pump flow rate Qs (t) on the suction side in this case is expressed by Expression (37) as the time change of $V_{st}(\theta_r)$ first, the relationship of Expression (16) is assigned, and the pump flow rate $Q_s(t)$ is expressed by Expression (38) in the end.

[Expression 37]

$$Q_s(t) = W \cdot \left\{\frac{dS_{s0}}{dt} - \frac{dS_{sv1}}{dt} - \frac{dS_{sv2}}{dt} - \frac{dS_{sv3}}{dt}\right\} \quad (37)$$

[Expression 38]

$$Q_s(t) = W \cdot \omega \cdot \left\{\frac{dS_{s0}}{dt} - \frac{dS_{sv1}}{dt} - \frac{dS_{sv2}}{dt} - \frac{dS_{sv3}}{dt}\right\} \quad (38)$$

By satisfying an effect element of $\beta \leq \alpha$ of Expression (10) in the first structure example of Embodiment 1, a first term in the curly brackets on the right-hand side in Expression (38) is given by a fixed value of Expression (19), and a second term and a fourth term are given by fixed values of Expression (39) even when the number of the suction working chambers is two as with a case where the number of the suction working chambers is three.

[Expression 39]

$$-\frac{dS_{sv1}}{d\theta_r} = -\frac{dS_{sv3}}{d\theta_r} = 0 \quad (39)$$

As above, it becomes possible to establish Expression (19) and Expression (22) or Expression (39) and cause all of the first term, the second term, and the fifth term in the curly brackets on the right-hand side in Expression (17) or the first term, the second term, and the fourth term in the curly brackets on the right-hand side in Expression (38) to be fixed values that do not change with time by simply satisfying the configuration condition of $\beta \leq \alpha$ in Expression (10) in the first structure example of Embodiment 1. As a result, it becomes possible to greatly contribute to the reduction of the time change of the pump flow rate $Q_s(t)$ on the suction port side.

The vanes having the distal end area of $S_{sv2}(\theta_r)$ are in the second portion, and hence a third term in the curly brackets on the right-hand side in Expression (38) becomes a fixed value of Expression (40) by giving the position $L(\theta)$ in the slits of those vanes by Expression (25), performing differentiation by $\theta$, and performing multiplication by the vane thickness T.

[Expression 40]

$$-\frac{dS_{vs2}(\theta_r)}{d\theta_r} = -T \cdot \frac{dL(\theta_r)}{d\theta_r} = -T \cdot \frac{dL(\theta)}{d\theta} = -T \cdot \frac{L_{max} - L_{min}}{\alpha} \quad (40)$$

It has been able to be proved that the suction-side pump flow rate $Q_s(t)$ becomes a fixed value on the right-hand side in Expression (41) when Expression (19), Expression (39), and Expression (40) are assigned to Expression (38) when the number of the working chambers in the suction stroke is two in the first structure example.

[Expression 41]

$$Q_s(t) = W \cdot \omega \cdot \left( \frac{R_{max}^2 - R_{min}^2}{2} - T \cdot \frac{L_{max} - L_{min}}{\alpha} \right) \quad (41)$$

Expression (41) is equal to Expression (34) and is a perfect fixed value. Therefore, it has been proved that the suction-side pump flow rate $Q_s(t)$ always becomes fixed and the fluctuation becomes zero regardless of the rotor rotation angle $\theta_r$ in the first structure example. The calculation result of $dS_t/d\theta_r$ in FIG. 11 is equivalent to the inside of the brackets on the right-hand side in Expression (34) or the right-hand side in Expression (41). Therefore, it has also been able to be verified that the fluctuation pattern of the suction-side pump flow rate in FIG. 11 calculated by obtaining the total area $S_t(\theta_r)$ of the suction working chambers as a function of $\theta_r$ and obtaining the gradient with respect to $\theta_r$ becomes a completely fixed value at the same time.

On the suction side in the first structure example, the fluctuation reduction effect due to the first configuration condition of Expression (10) being satisfied is great because the right-hand sides in Expression (34) and Expression (41) become the same fixed values, but it becomes possible to further reduce the time change of the pump flow rate $Q_s(t)$ to be completely zero by further satisfying the second configuration condition in Expression (12) and a third configuration condition that defines the profile of the cam-ring inner circumferential surface 14*a* in the second interval by Expression (24) to Expression (26).

A discharge-side pump flow rate $Q_d(t)$ when the number of the discharge working chambers is three in the first structure example of Embodiment 1 is calculated by a similar procedure by performing replacement and the like below in each of Expressions of (13), (14), (15), (17), (18), (19), (22), (31), (32), (33), (34) in the calculation procedure of the suction-side pump flow rate $Q_s(t)$ described above. In other words, $V_{st}(\theta_r)$ is replaced with a total volume $V_{dt}(\theta_r)$ of each discharge-side working chamber volume, $S_{s1}(\theta_r)$, $S_{s2}(\theta_r)$, $S_{s3}(\theta_r)$ are replaced with $S_{d1}(\theta_r)$, $S_{d2}(\theta_r)$, $S_{d3}(\theta_r)$ shown in FIG. 16, $S_{s0}(\theta_r)$, $S_{sv1}(\theta_r)$, $S_{sv2}(\theta_r)$, $S_{sv3}(\theta_r)$, $S_{sv4}(\theta_r)$ are replaced with $S_{d0}(\theta_r)$, $S_{dv1}(\theta_r)$, $S_{dv2}(\theta_r)$, $S_{dv3}(\theta_r)$, $S_{dv4}(\theta_r)$ shown in FIG. 17 and FIG. 18, $Q_s(t)$ is replaced with $Q_d(t)$, $R_{max}$ and $R_{min}$ are replaced with each other, $L(\theta)$ in Expression (31) and Expression (32) is given by functional forms of Expression (28) and Expression (30), respectively, and $L_{max}$ and $L_{min}$ are replaced with each other. As a result, the discharge-side pump flow rate $Q_d(t)$ when the number of the discharge working chambers is three is calculated by Expression (42).

[Expression 42]

$$Q_d(t) = -W \cdot \omega \cdot \left( \frac{R_{max}^2 - R_{min}^2}{2} - T \cdot \frac{L_{max} - L_{min}}{\alpha} \right) \quad (42)$$

The discharge-side pump flow rate $Q_d(t)$ when the number of the discharge working chambers is two in the first structure example of Embodiment 1 is calculated by a similar procedure by performing replacement and the like below in each of Expressions of (35), (36), (37), (38), (18), (19), (39), (40), (41) in the calculation procedure of the suction-side pump flow rate $Q_s(t)$ described above. In other words, $V_{st}(\theta_r)$ is replaced with each the total volume Vat $(\theta_r)$ of the discharge-side working chamber volume, $S_{s1}(\theta_r)$, $S_{s2}(\theta_r)$ are replaced with $S_{d1}(\theta_r)$, $S_{d2}(\theta_r)$ shown in FIG. 13, $S_{s0}(\theta_r)$, $S_{sv1}(\theta_r)$, $S_{sv2}(\theta_r)$, $S_{sv3}(\theta_r)$ are replaced with $S_{d0}(\theta_r)$, $S_{dv1}(\theta_r)$, $S_{dv2}(\theta_r)$, $S_{dv3}(\theta_r)$ shown in FIG. 14 and FIG. 15, $Q_s(t)$ is replaced with $Q_d(t)$, $R_{max}$ and $R_{min}$ are replaced with each other, $L(\theta)$ in Expression (40) is given by a functional form of Expression (29), and $L_{max}$ and $L_{min}$ are replaced with each other. As a result, the discharge-side pump flow rate $Q_d(t)$ when the number of the discharge working chambers is two is calculated by Expression (43). Expression (43) is equal to Expression (42) and is a perfect fixed value. Therefore, it has been proved that the discharge-side pump flow rate $Q_d(t)$ also always becomes fixed and the fluctuation becomes zero regardless of the rotor rotation angle $\theta_r$ in the first structure example. The calculation result of $dS_t/d\theta_r$ in FIG. 12 is equivalent to the inside of the brackets on the right-hand side in Expression (42) or the right-hand side in Expression (43). Therefore, it has also been able to be verified that the fluctuation pattern of the discharge-side pump flow rate in FIG. 12 calculated by obtaining the total area $S_t(\theta_r)$ of the discharge working chambers as a function of $\theta_r$ and obtaining the gradient with respect to $\theta_r$ becomes a completely fixed value at the same time.

[Expression 43]

$$Q_d(t) = -W \cdot \omega \cdot \left( \frac{R_{max}^2 - R_{min}^2}{2} - T \cdot \frac{L_{max} - L_{min}}{\alpha} \right) \quad (43)$$

The fluctuation reduction effect due to the first configuration condition of Expression (10) is also great on the discharge side because the right-hand sides in Expression (42) and Expression (43) are caused to become the same fixed values, but it becomes possible to further reduce the time change of the pump flow rate $Q_d(t)$ to be completely zero by further satisfying the second configuration condition of Expression (12) and the third configuration condition that defines the profile of the cam-ring inner circumferential surface 14*a* in the fourth interval by Expression (28) to Expression (30).

To define the profile of the cam-ring inner circumferential surface 14*a* by Expression (24) to Expression (26) and Expression (28) to Expression (30) respectively in the second interval and the fourth interval means to give the vane position $L(\theta_r)$ at the rotor rotation angle $\theta_r$ corresponding to $\theta$ in those expressions by the functional forms of Expression (4) to Expression (9), in other words, "to form the profile of the cam-ring inner circumferential surface by the first portion, the second portion, and the third portion smoothly connected in order in the interval of the rotor rotation angle $\theta_r$ in which the rotor slit direction displacement $L(\theta_r)$ of the fixed point on the vane with respect to the rotor center changes, and give $L(\theta_r)$ as a linear function of $\theta_r$ in the second portion and a sum of a linear function of $\theta_r$ and a periodic function of which period is $2\gamma_1$ in the first portion and the third portion, cause a differential value of the function $L(\theta_r)$ by $\theta_r$ to become zero at a starting end of the first portion and a terminal end of the third portion, be a same value at a terminal end of the first portion and a starting end of the third portion, and be a fixed value equal to the same value in the second portion when the change amount of $\theta_r$ is equally $\gamma_1$ in the first portion and the third portion and the change amount of $\theta_r$ of the second portion is $\gamma_2$", and this is an expression by a sentence of the third configuration condition of the present invention.

As above, in the first structure example of Embodiment 1, it is proved that it becomes possible to theoretically cause the fluctuation of the pump flow rate to be zero by satisfying the first configuration condition of Expression (10) in the present invention, also satisfying the second configuration condition of Expression (11) by satisfying Expression (12), giving the vane position $L(\theta_r)$ by the functional forms of Expression (4) to Expression (9), and also satisfying the third configuration condition of defining the cam-ring inner circumferential surface 14*a*. The first structure example is particularly characterized in that the above can be realized by a configuration in which the number of vanes is small ($N_v$=5). The pump flow rate $Q_d(t)$ on the discharge side in Expression (42) and Expression (43) has the same absolute value and has different signs from the pump flow rate $Q_s(t)$ on the suction side in Expression (34) and Expression (41), but this is due to the difference between suction and discharge. When $Q_s(t)$ and $Q_d(t)$ are divided by $W\cdot\omega$, $dS_f/d\theta_r$ in FIG. 11 and FIG. 12 is obtained, but values calculated with use of various dimensions in the first structure example are 126.08 and −126.08 on the suction side and the discharge side, respectively, and exactly match with the fixed values obtained by the calculation of FIG. 11 and FIG. 12.

The rotary-vane-type hydraulic pump that is the second structure example of Embodiment 1 of the present invention in which each working chamber performs a plurality of times of suction and discharge during one rotor rotation is described with reference to FIG. 19 to FIG. 22. FIG. 19 is a diagram showing how vanes move in accordance with the rotor rotation angle in order to define a cam ring profile in the second structure example. FIG. 20 is a front view showing the cam ring profile, a rotor, each vane, a suction port, and a discharge port of the second structure example. FIG. 21 is a diagram showing a change of the volume of each working chamber that communicates with one suction port in the second structure example and the total volume thereof as functions of the rotor rotation angle. FIG. 22 is a diagram showing a pump flow-rate fluctuation pattern from one suction port of the second structure example of Embodiment 1 that is the differential value of the total volume in FIG. 21 by the rotor rotation angle.

The change amount of $\theta_r$ in each of the intervals from the first interval to the fifth interval in the second structure example in FIG. 19 is $\theta_1=\pi/10$ (18°), $\theta_2=3\pi/10$ (54°), $\theta_3=\pi/5$ (36°), $\theta_4=3\pi/10$ (54°), and $\theta_5=\pi/10$) (18°, and $\gamma_1=\pi/10$ (18°) and $\gamma_2=\pi/10$ (18°) are also satisfied in each portion. Therefore, every change amount of $\theta_r$ in each portion and each interval in the second structure example is half of each interval in the first structure example shown in FIG. 8. As a result, the suction and discharge are performed two times during one rotor rotation. As shown in FIG. 20, the number of vanes 23 $N_v$=10 is satisfied, and hence $\alpha=2\pi/10=\pi/5$ (36°) is satisfied, which is also half of that of the first structure example. The dimension of each portion is $L_{min}$=21 mm, $L_{max}$=24 mm, the rotor diameter $D_r$=45 mm, the vane distal-end circular-arc radius $R_v$=2.5 mm, the distal-end circular-arc-center offset $O_f$=0 mm, and the vane thickness T=1.6 mm.

The first configuration condition of Expression (10) and the second configuration condition of Expression (12) derived from Expression (11) are also satisfied by the setting of the angle of each portion in the second structure example of Embodiment 1. As with the first structure example, $L(\theta_r)$ of each portion interval in FIG. 19 is given by the functional forms of Expression (4) to Expression (9), and hence the third configuration condition of the present invention is also satisfied. Expression (4') to Expression (9') in FIG. 19 are expressions in which $\theta_r$ in Expression (4) to Expression (9) is replaced with $\theta_r-\pi$, but the functional forms are the same.

In the second structure example of Embodiment 1, there are two suction ports and two discharge ports as shown in FIG. 20. However, a calculation result relating to the pump flow rate fluctuation passing through one of the suction ports is shown in FIG. 21 and FIG. 22 here. In the second structure example, as shown in FIG. 20, there are ten working chambers of which phases are shifted from each other by the angle $\alpha=\pi/5$ (36°) between the adjacent rotor slits, the working chambers each communicate with the suction ports one after another in accordance with the rotation of the rotor 22, and the number of the working chambers that communicate with the suction ports at a certain $\theta_r$ in FIG. 21 is three or two depending on the time as with the first structure example. This is due to all of the angle specifications described above being reduced to half and the ratio between each angle not changing from the first structure example.

As with FIG. 9, when the number of the working chambers that communicate with one suction port changes, the size of the total area thereof changes in a stepwise manner also in FIG. 21, but the change is made with a fixed gradient while the number of the communicating working chambers does not change. As a result, it can be confirmed that the differential value of the total area by the rotor rotation angle shown in FIG. 22 becomes a fixed value in the entire region of $\theta_r$, and the flow rate fluctuation becomes zero as a result of the pump flow rate pattern passing through one suction port being fixed.

As described above, all of the first configuration condition, the second configuration condition, and the third configuration condition of the present invention are also satisfied in the second structure example, and hence the verification result that directly proves that the pump flow rate fluctuation becomes zero without obtaining the working chamber area in the first structure example can be directly applied. In other words, it is proved that a feature in which the pump flow rate passing through one suction port theoretically becomes the fixed value on the right-hand side in Expression (34) and Expression (41) in the first structure example is also established in the second structure example and that the pump flow rate pattern passing through the suction port in FIG. 22 becomes fixed. At the same time, the verification result in the first structure example can also be directly applied to the discharge side, and hence it can also be proved that the pump flow rate passing through one discharge port in the second structure example theoretically becomes the fixed value on the right-hand side in Expression (42) and Expression (43).

There are two suction ports and two discharge ports in the second structure example of Embodiment 1. Therefore, the pump flow rate $Q_s(t)$ on the suction side is twice as much as the right-hand side in Expression (34) and Expression (41) and is expressed by Expression (44), and the pump flow rate $Q_d(t)$ on the discharge side is also twice as much as the right-hand side in Expression (42) and Expression (43) and is expressed by Expression (45). Both are fixed values, and the flow rate fluctuation is zero.

[Expression 44]

$$Q_s(t) = 2W \cdot \omega \cdot \left( \frac{R_{max}^2 - R_{min}^2}{2} - T \cdot \frac{L_{max} - L_{min}}{\alpha} \right) \quad (44)$$

[Expression 45]

$$Q_d(t) = -2W \cdot \omega \cdot \left( \frac{R_{max}^2 - R_{min}^2}{2} - T \cdot \frac{L_{max} - L_{min}}{\alpha} \right) \quad (45)$$

As above, it is proved that the pump flow rate also becomes the fixed values of Expression (44) and Expression (45) and the fluctuation thereof also theoretically becomes zero in the second structure example of Embodiment 1. The value obtained by dividing $Q_s(t)$ on the suction side of Expression (44) by $2W \cdot \omega$ becomes $dS_r/d\theta_r$ in FIG. 22. The value calculated with use of various dimensions of the second structure example is 67.36 and exactly matches with the fixed calculation value in FIG. 22. The second structure example is particularly characterized in that the bearing load and the vibration become smaller. This is because the part configuration is disposed to be symmetrical about a point of the rotor center, and the force by the surface pressure and the inertial force that act on parts having the same shape and opposite from each other by 180° offset each other and disappear.

A rotary-vane-type hydraulic pump that is the third structure example of Embodiment 1 of the present invention is described with reference to FIG. 23 and FIG. 24. FIG. 23 is a diagram showing how the vanes move in accordance with the rotor rotation angle in order to define a cam ring profile of the rotary-vane-type hydraulic pump that is the third structure example of Embodiment 1 of the present invention in which a circular arc portion of the cam ring profile is extended. FIG. 24 is a front view showing the cam ring profile, a rotor, each vane, a suction port, and a discharge port of the third structure example.

In the third structure example of Embodiment 1, the change amount of $\theta_r$ in the first interval to the fifth interval in FIG. 23 is $\theta_1=\pi/5$ (36°), $\theta_2=53\pi/90$ (106°), $\theta_3=19\pi/45$ (76°), $\theta_{4=53}\pi/90$ (106°), and $\theta_5=\pi/5$ (36°), the change amount of $\theta_r$ in each portion is $\gamma_1=17\pi/90$ (34°) and $\gamma_2=19\pi/90$ (38°), and $L(\theta_r)$ in each portion is given by the functional forms of Expression (4) to Expression (9). Regarding the vanes, the number $N_v=5$ and $\alpha=2\pi/5$ (72°) are satisfied. Each portion dimension is $L_{min}=21$ mm, $L_{max}=26$ mm, the rotor diameter $D_r=46$ mm, the vane distal-end circular-arc radius $R_v=3$ mm, the distal-end circular-arc-center offset $O_f=2$ mm, and the vane thickness T=1.6 mm.

Therefore, the first configuration condition of Expression (10) and the second configuration condition of Expression (12) derived from Expression (11) are also satisfied by the setting of the angle of each portion described above in the third structure example. As with the first structure example, $L(\theta_r)$ in each portion in FIG. 23 is given by the functional forms of Expression (4) to Expression (9), and hence the third configuration condition of the present invention is also satisfied. Therefore, the verification result performed in the first structure example can also be directly applied in the third structure example. In other words, it can also be proved that the pump flow rate $Q_s(t)$ on the suction side is theoretically given by Expression (46) equal to Expression (34) and Expression (41), and the discharge-side pump flow rate $Q_d(t)$ is theoretically given by Expression (47) equal to Expression (42) and Expression (43) in the third structure example. Both are fixed values, and the flow rate fluctuation is zero.

[Expression 46]

$$Q_s(t) = W \cdot \omega \cdot \left( \frac{R_{max}^2 - R_{min}^2}{2} - T \cdot \frac{L_{max} - L_{min}}{\alpha} \right) \quad (46)$$

[Expression 47]

$$Q_d(t) = -W \cdot \omega \cdot \left( \frac{R_{max}^2 - R_{min}^2}{2} - T \cdot \frac{L_{max} - L_{min}}{\alpha} \right) \quad (47)$$

As above, it is proved that the fluctuation of the pump flow rate also theoretically becomes zero in the third structure example of Embodiment 1. The third structure example is particularly characterized in that the occurrence of a pulse-like pressure pulsation and leakage between the ports when the ports that communicate with the working chambers are switched is easily suppressed. The is because $\theta_3$ (76°) of the third interval is caused to be greater than $\alpha$ (72°), the interval between each port in FIG. 24 is caused to be wider than the width of the working chamber, the pulse pulsation is alleviated by formation of a notch portion, and airtightness between each port by vane end surfaces is improved.

Embodiment 2

A rotary-vane-type hydraulic pump that is a structure example of Embodiment 2 of the present invention is described with reference to FIG. 25 to FIG. 29. FIG. 25 is a diagram showing how vanes move in accordance with the rotor rotation angle in order to define a cam ring profile in the structure example of Embodiment 2. FIG. 26 is a front view showing the cam ring profile, a rotor, each vane, a suction port, and a discharge port of this structure example. FIG. 27 is a diagram showing a change of a front area of each working chamber in a suction stroke and a total area thereof in the structure example of Embodiment 2 in FIG. 26 as functions of a rotor rotation angle. FIG. 28 is a diagram showing a pump flow-rate fluctuation pattern on the suction side of the structure example of Embodiment 2 that is a differential value of the total area in FIG. 27 by the rotor rotation angle. FIG. 29 is a diagram for describing the reason the flow rate fluctuation becomes zero by the general structure of Embodiment 2.

The change amount of $\theta_r$ in each of the intervals from the first interval to the fifth interval in FIG. 25 in the structure example of Embodiment 2 is $\theta_1=\pi/8$) (22.5°, $\theta_{2=3}\pi/4$ (135°), $\theta_3=\pi/4$ (45°), $\theta_4=\pi/4$ (135°), and $\theta_5=\pi/8$ (22.5°), the change amount of $\theta_r$ in each portion is $\gamma_1=\gamma_3=\pi/4$ (45°) and $\gamma_2=\pi/4$ (45°), and $L(\theta_r)$ in each portion is given by the functional forms of Expression (4) to Expression (9). Regarding the vanes, the number $N_v=8$ and $\alpha=2\pi/8=\pi/4$ (45°) are satisfied. Each portion dimension is $L_{min}=21$ mm, $L_{max}=26$ mm, the rotor diameter $D_r=46$ mm, the vane distal-end circular-arc radius $R_v=3$ mm, the distal-end circular-arc-center offset $O_f=0$ mm, and the vane thickness T=1.6 mm.

In the structure example of Embodiment 2, $\alpha=\pi/4$) (45° is satisfied for both cases in which $\beta$ is $\theta_1+\theta_5=\pi/4$) (45° and $\theta_3=\pi/4$ (45°), and hence Expression (10) that is the first configuration condition of the invention is satisfied. Here, $\gamma=2\gamma_1+\gamma_2$ and $\gamma_1=\gamma_2=a$ are satisfied on the left-hand side in Expression (11), and hence the entire left-hand side becomes $2\alpha$. In addition, $\alpha'=2\alpha$ and $\gamma_2-\alpha$ are satisfied on the right-hand side, and hence the entire right-hand side becomes $n\alpha$, and Expression (11) is established by n=2 (integer of 2 or more). Therefore, this structure example also satisfies Expression (11) that is the second configuration condition of the invention. The third configuration condition of the invention is also satisfied by giving $L(\theta_r)$ in each portion by the functional forms of Expression (4) to Expression (9).

As the general structure of Embodiment 2, the common change amount $\gamma_1$ of $\theta_r$ in the first portion and the third portion and the change amount $\gamma_2$ of $\theta_r$ in the second portion interval are given by Expression (48) and Expression (49) with use of the angle $\alpha$ between the vane slits and $n_1$ and $n_2$ that are freely-selected natural numbers. When those expressions are used, the left-hand side in Expression (11) becomes $2n_1\alpha$ also in consideration of $\gamma=2\gamma_1+\gamma_2$ and the right-hand side becomes $n\cdot\alpha$ also in consideration of $\alpha'=(n_2+1)\alpha$. Here, $n_1$ on the left-hand side is a freely-selected natural number, and hence n on the right-hand side becomes an integer of 2 or more, and Expression (11) is established. In other words, the second configuration condition of the present invention is rewritten to Expression (48) and Expression (49) in Embodiment 2. Here, $n_1$ and $n_2$ are freely-selected natural numbers.

[Expression 48]

$$\gamma_1=n_1\cdot\alpha \tag{48}$$

[Expression 49]

$$\gamma_2=n_2\cdot\alpha \tag{49}$$

In the structure example of Embodiment 2, the number of vanes is eight, and hence there are always eight working chambers of which phases are shifted from each other by $\alpha=2\pi/8$ (45°) as shown in FIG. 26. FIG. 27 shows the change of the front area S of each working chamber when the above is in the suction stroke as a function of the rotor rotation angle $\theta_r$. The number of the suction working chambers each in the position of a certain $\theta_r$ in the horizontal axis is always four, and the calculation result of the total area $S_t(\theta_r)$ of those front areas $S(\theta_r)$: S1 to S4 is also shown in the same drawing. The differential value $dS_t/d\theta_r$ of the total area $S_t(\theta_r)$ by the rotor rotation angle $\theta_r$ in FIG. 27 is shown in FIG. 28 as the pump flow-rate fluctuation pattern on the suction side, but it can be understood that the differential value $dS_t/d\theta_r$ is a fixed value in the entire range of the rotor rotation angle $\theta_r$, and the fluctuation of the pump flow rate $Q_s(t)$ on the suction side can also be caused to be zero in the structure example of Embodiment 2. It is understood that, when the pump flow-rate fluctuation pattern on the discharge side is calculated by a similar procedure, the pump flow-rate fluctuation pattern also becomes a fixed value and the fluctuation of the pump flow rate $Q_d(t)$ on the discharge side can also be caused to be zero as with the first structure example of Embodiment 1.

The reason the fluctuation of the pump flow rate $Q_s(t)$ on the suction side in the structure example of Embodiment 2 becomes zero is described below with use of expressions. In this structure example, the number of the working chambers in the suction stroke is always four and the number of the vanes forming the working chambers is five as in FIG. 26, and hence Expression (17) of $Q_s(t)$ when the number of the working chambers is three and the number of the vanes forming the working chambers is four as in FIG. 13 is rewritten to Expression (50). Here, $S_{sv5}$ is an area of a distal end portion of the vane that is added by one number. The structure example of Embodiment 2 also satisfies Expression (10) that is the first configuration condition of the invention.

Therefore, as with Embodiment 1, a first term in the curly brackets in Expression (50) is a fixed value in accordance with Expression (19) and a second term and the final term in the curly brackets become fixed values of zero in Expression (51).

[Expression 50]

$$Q_s(t) = W\cdot\omega\cdot\left\{\frac{dS_{s0}}{d\theta_r}-\frac{dS_{s1}}{d\theta_r}-\frac{dS_{s2}}{d\theta_r}-\frac{dS_{s3}}{d\theta_r}-\frac{dS_{s4}}{d\theta_r}-\frac{dS_{s5}}{d\theta_r}\right\} \tag{50}$$

[Expression 51]

$$-\frac{dS_{sv1}}{d\theta_r}=-\frac{dS_{sv5}}{d\theta_r}=0 \tag{51}$$

Here, Expression (4) to Expression (9) are rewritten to Expression (52) to Expression (54) with use of the rotor rotation angle $\theta$ of the starting end reference of the second interval in accordance with Expression (23). The functional forms of the vane position L of a third term to a fifth term in the curly brackets in Expression (50) are given by each of Expression (52) to Expression (54) in accordance with the rotor rotation angle $\theta$.

[Expression 52]

$$L(\theta)=\frac{L_{max}-L_{min}}{2(\gamma_1+\gamma_2)}\cdot\theta-\frac{L_{max}-L_{min}}{2(\gamma_1+\gamma_2)}\cdot\frac{\gamma_1}{\pi}\cdot\sin\left(2\pi\frac{\theta}{2\gamma_1}\right)+L_{min} \tag{52}$$

in the first portion $0\le\theta<\gamma_1$ in the second interval

[Expression 53]

$$L(\theta)=\frac{L_{max}-L_{min}}{\gamma_1+\gamma_2}\cdot\theta-\frac{L_{max}-L_{min}}{2(\gamma_1+\gamma_2)}\cdot\gamma_1\cdot L_{min} \tag{53}$$

in the second portion $\gamma_1\le\theta<\gamma_1+\gamma_2$ in the second interval

[Expression 54]

$$L(\theta)=\frac{L_{max}-L_{min}}{2(\gamma_1+\gamma_2)}\cdot\theta-\frac{L_{max}-L_{min}}{2(\gamma_1+\gamma_2)}\cdot\frac{\gamma_1}{\pi}\cdot\sin\left(2\pi\frac{\theta-\gamma_2}{2\gamma_1}\right)+\frac{L_{max}-L_{min}}{2(\gamma_1+\gamma_2)}\cdot\gamma_2+L_{min} \tag{54}$$

in the third portion $\gamma_1+\gamma_2\le\theta<2\gamma_1+\gamma_2$ in the second interval Expressions of the third term and the fifth term in the curly brackets on the right-hand side in Expression (50) are calculated by Expression (55) and Expression (56) by giving the functional forms of $L(\theta)$ that are the vane positions thereof by each of Expression (52) and Expression (54), performing differentiation by $\theta$, and performing multiplication by the vane thickness T. At the time of derivation of Expression (56), the relationships of $\alpha'=2\alpha$ and $\gamma_1-\gamma_2-\alpha$ in the structure example of Embodiment 2 are also used. The total thereof is a fixed value on the rightmost-hand side in Expression (57).

[Expression 55]

$$-\frac{dS_{sv2}}{d\theta_r} = -T\cdot\frac{dL(\theta)}{d\theta} = -T\cdot\frac{L_{max}-L_{min}}{2(\gamma_1+\gamma_2)} + T\cdot\frac{L_{max}-L_{min}}{2(\gamma_1+\gamma_2)}\cdot\cos\left(2\pi\frac{\theta}{2\gamma_1}\right) \tag{55}$$

[Expression 53]

$$-\frac{dS_{sv4}}{d\theta_r} = -T\cdot\frac{dL(\theta+\alpha')}{d\theta} = -T\cdot\frac{L_{max}-L_{min}}{2(\gamma_1+\gamma_2)} + T\cdot\frac{L_{max}-L_{min}}{2(\gamma_1+\gamma_2)}\cdot\cos\left(2\pi\frac{\theta+2\alpha-\gamma_2}{2\gamma_1}\right) = -T\cdot\frac{L_{max}-L_{min}}{2(\gamma_1+\gamma_2)} + T\cdot\frac{L_{max}-L_{min}}{2(\gamma_1+\gamma_2)}\cdot\cos\left(2\pi\frac{\theta}{2\gamma_1}+\pi\right) \tag{53}$$

[Expression 57]

$$-\frac{dS_{sv2}}{d\theta_r} - \frac{dS_{sv4}}{d\theta_r} = -T\cdot\frac{L_{max}-L_{min}}{\gamma_1+\gamma_2} = -T\cdot\frac{L_{max}-L_{min}}{2\alpha} \tag{57}$$

A fourth term in the curly brackets on the right-hand side in Expression (50) becomes a fixed value on the rightmost-hand side in Expression (58) by giving the functional form of $L(\theta+\alpha)$ that is the vane position thereof by Expression (53), performing differentiation by $\theta$, performing multiplication by the vane thickness T, and also using a relationship of $\gamma_1=\gamma_2=\alpha$ in the structure example of Embodiment 2.

[Expression 58]

$$-\frac{dS_{sv3}}{d\theta} = -T\cdot\frac{dL(\theta+\alpha)}{d\theta} = -T\cdot\frac{L_{max}-L_{min}}{\gamma_1+\gamma_2} = -T\cdot\frac{L_{max}-L_{min}}{2\alpha} \tag{58}$$

Expression (19), Expression (51), Expression (57), and Expression (58) are assigned to Expression (50), and the pump flow rate $Q_s(t)$ on the suction side in the structure example of Embodiment 2 is obtained as a fixed value on the right-hand side in Expression (59) equal to Expression (34) and Expression (41) in the first structure example of Embodiment 1. As a result, it is proved that the fluctuation of the suction-side pump flow rate also theoretically becomes zero in the structure example of Embodiment 2. At the same time, it has also been able to be verified that the total volume $S_t$ of the suction working chamber is obtained as the function of $\theta_r$, and the fluctuation pattern $dS_t/d\theta_r$ of the pump flow rate $Q_s(t)$ on the suction side in FIG. 28 calculated from the gradient with respect to $\theta_r$ always becomes a fixed value. The value obtained by dividing $Q_s(t)$ on the suction side of Expression (59) by $W\cdot\omega$ becomes $dS_t/d\theta_r$ in FIG. 28. The value calculated with use of various dimensions of the structure example of Embodiment 2 is 122.31 and exactly matches with the fixed calculation value in FIG. 28. The discharge-side pump flow rate $Q_d(t)$ in the structure example of Embodiment 2 is similarly obtained as a fixed value on the right-hand side in Expression (60).

[Expression 59]

$$Q_s(t) = W\cdot\omega\cdot\left(\frac{R_{max}^2-R_{min}^2}{2} - T\cdot\frac{L_{max}-L_{min}}{\alpha}\right) \tag{59}$$

[Expression 60]

$$Q_d(t) = -W\cdot\omega\cdot\left(\frac{R_{max}^2-R_{min}^2}{2} - T\cdot\frac{L_{max}-L_{min}}{\alpha}\right) \tag{60}$$

In Embodiment 2, the second configuration condition of a general structure including not only the structure examples shown in FIG. 25 and FIG. 26 but also other structure examples is Expression (48) and Expression (49). In other words, both of $\gamma_1$ common to the first portion and the third portion and $\gamma_2$ of the second portion in intervals in which the vanes perform an advance and retreat movement are multiples of the angle $\alpha$ between the vane slits. At this time, for example, the number of the vanes in the second interval on the suction side is $2n_1+n_2$, and hence Expression (61) is obtained when Expression (50) is rewritten to a general form using $n_1$ and $n_2$. The general structure of Embodiment 2 also satisfies the first configuration condition of Expression (10), and hence a first term in the curly brackets on the right-hand side becomes Expression (19), and a second term and the final term become Expression (62).

[Expression 61]

$$Q_s(t) = W\cdot\omega\cdot\left\{\frac{dS_{s0}}{d\theta_r} - \frac{dS_{sv1}}{d\theta_r} - \sum_{m=1}^{2n_1+n_2}\frac{dS_{sv(m+1)}}{d\theta_r} - \frac{dS_{sv(2n_1+n_2+2)}}{d\theta_r}\right\} \tag{61}$$

[Expression 62]

$$-\frac{dS_{sv1}}{d\theta_r} = -\frac{dS_{sv(2n_1+n_2+2)}}{d\theta_r} = 0 \tag{62}$$

A sum total portion of a third term on the right-hand side in the curly brackets in Expression (61) is expressed by Expression (63) when being separated into the sum total of the vanes in each portion. Each term on the right-hand side in Expression (63) corresponds to the first portion, the second portion, and the third portion, and hence is calculated by Expression (64) to Expression (66) by giving the functional form of $L(\theta)$ that is each of the vane positions by Expression (52) to Expression (54), performing differentiation by $\theta$, and performing multiplication by the vane thickness T. The relationship of Expression (48) is used at the time of derivation of Expression (64), and the relationship of Expression (48) and Expression (49) is used at the time of derivation of Expression (66).

[Expression 63]

$$-\sum_{m=1}^{2n_1+n_2}\frac{dS_{sv(m+1)}}{d\theta_r} = -\sum_{m=1}^{n_1}\frac{dS_{sv(m+1)}}{d\theta_r} - \sum_{m=n_1+1}^{n_1+n_2}\frac{dS_{sv(m+1)}}{s\theta_r} - \sum_{m=n_1+n_2+1}^{2n_1+n_2}\frac{dS_{sv(m+1)}}{d\theta_r} \tag{63}$$

[Expression 64]

$$-\sum_{m=1}^{n_1}\frac{dS_{sv(m+1)}}{d\theta_r} = -T\sum_{m=1}^{n_1}\frac{dL(\theta+(m-1)\alpha)}{d\theta} = -T\cdot n_1\cdot\frac{L_{max}-L_{min}}{2(\gamma_1+\gamma_2)} + T\cdot\frac{L_{max}-L_{min}}{2(\gamma_1+\gamma_2)}\cdot\sum_{m=1}^{n_2}\cos\left(2\pi\frac{\theta}{2\gamma_1}+\frac{2\pi}{2n_1}(m-1)\right) \tag{64}$$

[Expression 65]

$$-\sum_{m=n_1+1}^{n_1+n_2}\frac{dS_{sv(m+1)}}{d\theta_r} = -T\sum_{m=n_1+1}^{n_1+n_2}\frac{dL(\theta+(m-1)\alpha)}{d\theta} = -T\cdot n_2\cdot\frac{L_{max}-L_{min}}{\gamma_1+\gamma_2} \tag{65}$$

-continued

[Expression 66]

$$-\sum_{m=n_1+n_2+1}^{2n_1+n_2}\frac{dS_{sv(m+1)}}{d\theta_r}= \tag{66}$$

$$-T\sum_{m=n_1+n_2+1}^{2n_1+n_2}\frac{dL(\theta+(m-1)\alpha)}{d\theta}=-T\sum_{m=n_1+n_2+1}^{2n_1+n_2}\frac{L_{max}-L_{min}}{2(\gamma_1+\gamma_2)}+$$

$$T\cdot\frac{L_{max}-L_{min}}{2(\gamma_1+\gamma_2)}\cdot\sum_{m=n_1+n_2+1}^{2n_1+n_2}\cos\left(\pi\frac{\theta-\gamma_2+(m-1)\alpha)}{\gamma_1}\right)=-T\cdot n_1\cdot$$

$$\frac{L_{max}-L_{min}}{2(\gamma_1+\gamma_2)}+T\cdot\frac{L_{max}-L_{min}}{2(\gamma_1+\gamma_2)}\cdot\sum_{m=n_1+1}^{2n_1}\cos\left(2\pi\frac{\theta}{2\gamma_1}+\frac{2\pi}{2n_1}(m-1)\right)$$

Expression (64) to Expression (66) are assigned to Expression (63), and a sum total portion of a third term in the curly brackets on the right-hand side in Expression (61) is rewritten as in Expression (67) first. A sum total portion of a third term on the right-hand side in Expression (67) is a sum of an X coordinate of a number of $2n_1$ mass points $M_1$ to $M_{2n1}$ that are the same in mass and are disposed at even intervals on a circle having a radius of 1 about a center of an origin O shown in FIG. 29 and becomes an X coordinate of the center of gravity thereof when being divided by $2n_1$. It is obvious that the center of gravity is in the origin by FIG. 29, and hence Expression (68) is always established. A fixed value of Expression (69) is obtained when relational expressions of Expression (48) and Expression (49) are used.

[Expression 67]

$$-\sum_{m=1}^{2n_1+n_2}\frac{dS_{sv(m+1)}}{d\theta_r}=-T\cdot n_1\cdot\frac{L_{max}-L_{min}}{\gamma_1+\gamma_2}- \tag{67}$$

$$T\cdot n_2\cdot\frac{L_{max}-L_{min}}{\gamma_1+\gamma_2}+T\cdot\frac{L_{max}-L_{min}}{2(\gamma_1+\gamma_2)}\cdot\sum_{m=1}^{2n_1}\cos\left(2\pi\frac{\theta}{2\gamma_1}+\frac{2\pi}{2n_1}(m-1)\right)$$

[Expression 68]

$$\sum_{m=1}^{2n_1}\cos\left(2\pi\frac{\theta}{2\gamma_1}+\frac{2\pi}{2n_1}(m-1)\right)=0 \tag{68}$$

[Expression 69]

$$-\sum_{m=1}^{2n_1+n_2}\frac{dS_{sv(m+1)}}{d\theta_r}=-T\cdot\frac{(n_1+n_2)(L_{max}-L_{min})}{\gamma_1+\gamma_2}=-\frac{T(L_{max}-L_{min})}{\alpha} \tag{69}$$

The pump flow rate $Q_s(t)$ on the suction side in the general structure of Embodiment 2 becomes a fixed value given by Expression (70) by assigning Expression (19), Expression (62), and Expression (69) to Expression (61). The value obtained by dividing $Q_s(t)$ on the suction side of Expression (70) by $W\cdot\omega$ becomes $dS_t/d\theta_r$ in FIG. 28. The value calculated with use of various dimensions of the structure example of Embodiment 2 is 122.31 and exactly matches with the fixed calculation value in FIG. 28. The discharge-side pump flow rate $Q_d(t)$ in the general structure of Embodiment 2 is also obtained as a fixed value on the right-hand side in Expression (71) by a procedure similar to that of the suction side.

[Expression 70]

$$Q_s(t)=W\cdot\omega\cdot\left(\frac{R_{max}^2-R_{min}^2}{2}-T\cdot\frac{L_{max}-L_{min}}{\alpha}\right) \tag{70}$$

[Expression 71]

$$Q_d(t)=-W\cdot\omega\cdot\left(\frac{R_{max}^2-R_{min}^2}{2}-T\cdot\frac{L_{max}-L_{min}}{\alpha}\right) \tag{71}$$

As a result of the above, it is also proved that the fluctuation of the pump flow rate theoretically becomes zero in the general structure of Embodiment 2 by satisfying the first configuration condition of Expression (10) in the present invention, also satisfying the second configuration condition of Expression of Expression (11) by satisfying Expression (48) and Expression (49), giving the vane position $L(\theta_r)$ by the functional forms of Expression (4) to Expression (9), and also satisfying the third configuration condition. The general structure of Embodiment 2 is particularly characterized in being advantageous in terms of speed-up because the inertial force can be reduced by increasing $n_1$ in Expression (48) and $n_2$ in Expression (49), expanding the radial-direction movement interval of the vanes, and causing the vanes to slowly advance and retreat.

Embodiment 3

A rotary-vane-type hydraulic pump that is Embodiment 3 of the present invention is described with reference to FIG. 30 to FIG. 33. FIG. 30 is a diagram showing how vanes move in accordance with the rotor rotation angle in order to define a cam ring profile in the structure example of Embodiment 3. FIG. 31 is a front view showing the cam ring profile, a rotor, each vane, a suction port, and a discharge port of this structure example. FIG. 32 is a diagram showing a change of a front area of each working chamber in a suction stroke and a total area thereof in the structure example in FIG. 31 as functions of a rotor rotation angle. FIG. 33 is a diagram showing a pump flow-rate fluctuation pattern on the suction side of the structure example of Embodiment 3 that is a differential value of the total area in FIG. 32 by the rotor rotation angle.

In the structure example of Embodiment 3, the change amount of $\theta_r$ in each of the intervals from the first interval to the fifth interval in FIG. 30 is $\theta_1=\pi/6$ (30°), $\theta_2=2\pi/3$ (120°), $\theta_3=\pi/3$ (60°), $\theta_4=12\pi/3$ (120°), and $\theta_5=\pi/6$ (30°), $\gamma_1=\pi/3$ (60°) and $\gamma_2=0°$ are satisfied in each portion, and the number of the vanes $N_v=6$ and $\alpha=2\pi/6=\pi/3$) (60° are satisfied. The functional form of $L(\theta_r)$ in each interval in FIG. 30 is given by each expression where $\gamma_2=0°$ is satisfied in Expression (1) to Expression (9) in Embodiment 1. Unlike the other embodiments, it is characterized in that $\gamma_2=0°$ is satisfied and there are no intervals in which $dL/d\theta_r$ becomes fixed. Each portion dimension is $L_{min}=21$ mm, $L_{max}=26$ mm, the rotor diameter $D_r=46$ mm, the vane distal-end circular-arc radius $R_v=3$ mm, the distal-end circular-arc-center offset $O_f=2$ mm, and the vane thickness T=1.6 mm.

In the structure example of Embodiment 3, $\alpha=\pi/3$) (60° and $\beta=\theta_1+\theta_5=\theta_3=\pi/3$ (60°) are satisfied as described above, and hence the first configuration condition of Expression (10) is satisfied as with Embodiment 1. In Embodiment 3, $\gamma_2=0°$ and $\alpha'=\alpha$ are satisfied. Therefore, the second configuration condition in Embodiment 3 is rewritten to Expression (72) where n is an integer of 2 or more from Expression (11), and the relational expression of $\gamma=2\gamma_1+\gamma_2$ is rewritten to Expression (73). The second configuration condition of Expression (72) can be established for a freely-selected integer n equal to or more than 2 by adjusting the number of the vanes $N_v$. However, in this structure example, $\gamma=\theta_2=\theta_4=2\pi/3$ (120°) and $\alpha=\pi/3$ (60°) are satisfied. Therefore, n=2 is satisfied, and the second configuration condition is satisfied in the form of Expression (74).

[Expression 72]

$$\gamma=n\cdot\alpha \tag{72}$$

[Expression 73]

$$\gamma=2\gamma_1 \tag{73}$$

[Expression 74]

$$\gamma=2\alpha \tag{74}$$

In the structure example of Embodiment 3, the number of vanes is six, and hence there are always six working chambers of which phases are shifted from each other by $\alpha=2\pi/6$ (60°) as shown in FIG. 31. FIG. 32 shows the change of the front area $S(\theta_r)$ of each working chamber when the above is in the suction stroke as a function of the rotor rotation angle $\theta_r$. The number of the suction working chambers each in the position of a certain $\theta_r$ in the horizontal axis is always three, the front areas thereof are shown by $S_1$ to $S_3$ in the drawing, and the calculation result of the total area $S_t(\theta_r)$ is also shown. The differential value $dS_t/d\theta_r$ of the total area $S_t(\theta_r)$ by the rotor rotation angle in FIG. 32 is shown in FIG. 33 as the pump flow-rate fluctuation pattern on the suction side, but it can be understood that the differential value $dS_t/d\theta_r$ is a fixed value in the entire range of the rotor rotation angle $\theta_r$, and the fluctuation of the pump flow rate $Q_d(t)$ on the suction side can also be caused to be zero in the structure example of Embodiment 3. It is understood that, when the pump flow-rate fluctuation pattern on the discharge side is calculated by an equivalent procedure, the pump flow-rate fluctuation pattern also becomes a fixed value and the fluctuation of the pump flow rate $Q_d(t)$ on the discharge side can also be caused to be zero.

The reason the fluctuation of the pump flow rate $Q_s(t)$ on the suction side in the structure example of Embodiment 3 also becomes zero is explained below with use of expressions. In Embodiment 3, there is a relationship of Expression (73) and $\gamma_2=0°$, and hence the following is obtained when Expression (4) to Expression (9) are rewritten with use of the rotor rotation angle $\theta$ ($\theta=\theta_r-\theta_1$) of the starting end reference of the interval. First, in Expression (4) to Expression (6) of the second interval that is the suction stroke, the interval of Expression (5) is removed and the intervals of Expression (4) and Expression (6) are connected. Expression (4) and Expression (6) become the same expressions. As a result, $L(\theta)$ indicating the rotor slit direction position of the vane distal-end circular-arc center point is integrated to one Expression (75) in one continuous interval. Similarly, also in Expression (7) to Expression (9) of the fourth interval that is the discharge stroke, the interval of Expression (8) is removed, and $L(\theta)$ of the intervals of Expression (7) and Expression (9) is integrated to one Expression (76) in one continuous interval.

[Expression 75]

$$L(\theta)=\frac{L_{max}-L_{min}}{\gamma}\cdot\theta-\frac{L_{max}-L_{min}}{2\pi}\cdot\sin\left(2\pi\frac{\theta}{\gamma}\right)+L_{min} \tag{75}$$

in the entire region of the second interval $\theta\leq\theta<\gamma$

[Expression 76]

$$L(\theta)=-\frac{L_{max}-L_{min}}{\gamma}\cdot\theta-\frac{L_{max}-L_{min}}{2\pi}\cdot\sin\left(2\pi\frac{\theta}{\gamma}\right)+L_{max} \tag{76}$$

in the entire region of the fourth interval $\theta\leq\theta\gamma$

In the structure example of Embodiment 3, both of the number of the working chambers in the suction stroke and the number of the working chambers in the discharge stroke are always three as shown in FIG. 32 and are the same to that in the suction stroke in FIG. 13 and the discharge stroke in FIG. 16 in the first structure example of Embodiment 1. Therefore, the pump flow rate $Q_s(t)$ on the suction side in the structure example of Embodiment 3 is expressed by Expression (77) that is the same as Expression (17) in the first structure example of Embodiment 1. The first configuration condition of Expression (10) is also satisfied in the structure example of Embodiment 3. Therefore, a first term in the curly brackets on the right-hand side in Expression (77) is given by Expression (19), and a second term and a fifth term are given by Expression (22) as with the first structure example of Embodiment 1.

[Expression 77]

$$Q_s(t)=W\cdot\omega\cdot\left\{\frac{dS_{s0}}{d\theta_r}-\frac{dS_{s1}}{d\theta_r}-\frac{dS_{s2}}{d\theta_r}-\frac{dS_{s3}}{d\theta_r}-\frac{dS_{s4}}{d\theta_r}\right\} \tag{77}$$

A third term and a fourth term in the curly brackets on the right-hand side in Expression (53) are calculated by Expression (78) and Expression (79), respectively, by giving the functional forms of the position $L(\theta)$ in the slits of the vanes by Expression (75), performing differentiation by $\theta$, and performing multiplication by the vane thickness T, and the total thereof becomes a fixed value of Expression (80).

[Expression 78]

$$-\frac{dS_{sv2}}{d\theta_r}=-T\cdot\frac{dL(\theta)}{d\theta}=-T\cdot\frac{L_{max}-L_{min}}{\gamma}+T\cdot\frac{L_{max}-L_{min}}{\gamma}\cdot\cos\left(2\pi\frac{\theta}{\gamma}\right) \tag{78}$$

[Expression 79]

$$\begin{aligned}-\frac{dS_{sv3}}{d\theta_r}&=\\ -T\cdot\frac{dL(\theta+\alpha)}{d\theta}&=-T\cdot\frac{L_{max}-L_{min}}{\gamma}+T\cdot\frac{L_{max}-L_{min}}{\gamma}\cdot\cos\left(2\pi\frac{\theta+\alpha}{\gamma}\right)=\\ &-T\cdot\frac{L_{max}-L_{min}}{\gamma}+T\cdot\frac{L_{max}-L_{min}}{\gamma}\cdot\cos\left(2\pi\frac{\theta}{\gamma}+\pi\right)\end{aligned} \tag{79}$$

[Expression 80]

$$-\frac{dS_{sv2}}{d\theta_r}-\frac{dS_{sv3}}{d\theta_r}=-T\cdot\frac{L_{max}-L_{min}}{\alpha} \tag{80}$$

Expression (19), Expression (22), and Expression (80) are assigned to Expression (77), and the pump flow rate $Q_s(t)$ on the suction side in the structure example of Embodiment 3 is obtained as a fixed value on the right-hand side in Expression (81). As a result, it can also be proved that the fluctuation of the suction-side pump flow rate theoretically becomes zero, and it can also be verified that the pump flow-rate fluctuation pattern $dS_t/d\theta_r$ in FIG. 33 becomes a fixed value in the structure example of Embodiment 3. The value obtained by dividing $Q_s(t)$ on the suction side of Expression (81) by $W\cdot\omega$ becomes $dS_t/d\theta_r$ in FIG. 33. The value calculated with use of various dimensions of the structure example of Embodiment 3 is 124.80 and exactly matches with the fixed calculation value in FIG. 33.

[Expression 81]

$$Q_s(t) = W\cdot\omega\cdot\left(\frac{R_{max}^2 - R_{min}^2}{2} - T\cdot\frac{L_{max} - L_{min}}{\alpha}\right) \tag{81}$$

The pump flow rate $Q_d(t)$ on the discharge side in the structure example of Embodiment 3 is obtained as a fixed value on the right-hand side in Expression (82) when the functional form of $L(\theta)$ is not given by Expression (28) and Expression (30) and is always given by Expression (76) in a procedure that derives Expression (42) in the first structure example of Embodiment 1. As a result, it is proved that the fluctuation of the discharge-side pump flow rate also theoretically becomes zero in the structure example of Embodiment 3.

[Expression 82]

$$Q_d(t) = -W\cdot\omega\cdot\left(\frac{R_{max}^2 - R_{min}^2}{2} - T\cdot\frac{L_{max} - L_{min}}{\alpha}\right) \tag{82}$$

In Embodiment 3, the second configuration condition of a general structure including not only the structure examples shown in FIG. 30 and FIG. 31 but also other structure examples is Expression (72), and $\theta_2$ of the second interval and $\theta_4$ of the fourth interval in FIG. 30 equivalent to $\gamma$ are n times of the angle $\alpha$ between the adjacent rotor slits. Here, n represents an integer of 2 or more. At this time, for example, the number of the vanes in the second interval is n, and hence Expression (83) is obtained when Expression (77) is rewritten to a general form using n. The general structure of Embodiment 3 also satisfies the first effect element of Expression (10), and hence a first term in the curly brackets on the right-hand side becomes Expression (19), and a second term and the final term become Expression (84).

[Expression 83]

$$Q_s(t) = W\cdot\omega\cdot\left\{\frac{dS_{s0}}{d\theta_r} - \frac{dS_{sv1}}{d\theta_r} - \sum_{m=1}^{n}\frac{dS_{sv(m+1)}}{d\theta_r} - \frac{dS_{sv(n+2)}}{d\theta_r}\right\} \tag{83}$$

[Expression 84]

$$-\frac{dS_{sv1}}{d\theta_r} = -\frac{dS_{sv(n+2)}}{d\theta_r} = 0 \tag{84}$$

A sum total of a third term in the curly brackets in Expression (83) is rewritten to Expression (85) as follows, and hence Expression (86) is obtained by giving the functional form of $L(\theta)$ by Expression (75), performing differentiation is by $\theta$, performing multiplication by the vane thickness T, and using the relationship of $\gamma=n\alpha$ in Expression (72).

[Expression 85]

$$-\sum_{m=1}^{n}\frac{dS_{sv(m+1)}}{d\theta_r} = -T\sum_{m=1}^{n}\frac{dL(\theta+(m-1)\alpha)}{d\theta} \tag{85}$$

[Expression 86]

$$\begin{aligned}-\sum_{m=1}^{n}\frac{dS_{sv(m+1)}}{d\theta_r} &= \\ -\frac{n\cdot T\cdot(L_{max}-L_{min})}{\gamma} + \frac{T\cdot(L_{max}-L_{min})}{\gamma}\sum_{m=1}^{n}\cos\left(2\pi\frac{(\theta+(m-1)\alpha)}{\gamma}\right) &= \\ -\frac{n\cdot T\cdot(L_{max}-L_{min})}{\gamma} + \frac{T\cdot(L_{max}-L_{min})}{\gamma}\sum_{m=1}^{n}\cos\left(2\pi\frac{\theta}{\gamma} + \frac{2\pi}{n}(m-1)\right)\end{aligned} \tag{86}$$

A sum total portion on the right-hand side in Expression (86) is a sum of an X coordinate of mass points $M_1$ to Mn of which number is changed from $2n_1$ to n and which are the same in mass and are disposed at even intervals on a circle having a radius of 1 about a center of the origin O shown in FIG. 29 and becomes an X coordinate of the center of gravity thereof when being divided by n. As with FIG. 29, the center of gravity is in the origin, and hence Expression (87) is always established. The sum total term in the curly brackets in Expression (83) becomes a fixed value on the rightmost-hand side in Expression (88) in the end because $\gamma$-n$\alpha$ is satisfied in the general structure of Embodiment 3.

[Expression 87]

$$\sum_{m=1}^{n}\cos\left(2\pi\frac{\theta}{\gamma} + \frac{2\pi}{n}(m-1)\right) = 0 \tag{87}$$

[Expression 88]

$$-\sum_{m=1}^{n}\frac{dS_{sv(m+1)}}{d\theta_r} = -\frac{n\cdot T\cdot(L_{max}-L_{min})}{\gamma} + \frac{T\cdot(L_{max}-L_{min})}{\alpha} \tag{88}$$

The pump flow rate $Q_s(t)$ on the suction side in the general structure of Embodiment 3 also becomes a fixed value given by Expression (89) by assigning Expression (19), Expression (84), and Expression (88) to Expression (83). The discharge-side pump flow rate $Q_d(t)$ in the general structure of Embodiment 3 is also obtained as a fixed value on the right-hand side in Expression (90) by a procedure similar to that of the suction side.

[Expression 89]

$$Q_s(t) = W\cdot\omega\cdot\left(\frac{R_{max}^2 - R_{min}^2}{2} - T\cdot\frac{L_{max} - L_{min}}{\alpha}\right) \tag{89}$$

[Expression 90]

$$Q_d(t) = -W\cdot\omega\cdot\left(\frac{R_{max}^2 - R_{min}^2}{2} - T\cdot\frac{L_{max} - L_{min}}{\alpha}\right) \tag{90}$$

As a result of the above, in the general structure of Embodiment 3, it is also proved that the fluctuation of the pump flow rate theoretically becomes zero by satisfying the first configuration condition of Expression (10) in the present invention, also satisfying the second configuration condition of Expression of Expression (11) by satisfying Expression (72), giving the vane position $L(\theta_r)$ by the functional forms based on Expression (4) to Expression (9), and also satisfying the third configuration condition. The general structure of Embodiment 3 is also particularly characterized in being advantageous in terms of speed-up because the inertial force can be reduced by increasing n in Expression (72), expanding the radial-direction movement interval of the vanes, and causing the vanes to slowly advance and retreat.

In all of the structure examples in each embodiment of the present invention, calculation expressions of the pump flow rates $Q_s(t)$ and $Q_d(t)$ for one suction port and one discharge port have different signs due to the difference between suction and discharge, but are expressions that give fixed values of which absolute values are equal to each other. When each $Q_s(t)$ and each $Q_d(t)$ are compared with each other between different structure examples, completely equal expressions are obtained. In one rotary-vane-type hydraulic pump, there is one way for numerical values of various symbols on the right-hand side in each expression. Therefore, even when structure examples are selected and combined for each of the sides of the suction side and the discharge, the flow rates on the suction side and the discharge side match and the continuity is maintained when the numbers of the pairs of the suction port and the discharge port are equal to each other. In other words, in the present invention, the rotary-vane-type hydraulic pump with a small pressure pulsation can be configured by combining freely-selected two out of all conceivable structure examples.

All of the embodiments of the present invention are in common with each other in that the embodiments satisfy Expression (10) relating to the relationship between the angle of the circular arc portion of the cam ring and the angle between the vane slits as the first configuration condition of the invention and satisfy common Expression (11) relating to the relationship between the angle in each interval and each portion in which the vanes move in the radial direction and the angle between the adjacent vane slits as the second configuration condition of the invention. Expression (11) is rewritten to Expression (12) in Embodiment 1, is rewritten to Expression (48) and Expression (49) in Embodiment 2, and is rewritten to Expression (72) in Embodiment 3. The third configuration condition of the invention is satisfied by giving the motion of the vanes by an expression based on Expression (4) to Expression (9). Expression (4) to Expression (9) are rewritten to Expression (24) to Expression (26) and Expression (28) to Expression (30) in Embodiment 1, are rewritten to Expression (52) to Expression (54) in Embodiment 2 as an example of the suction side portion, and are rewritten to Expression (75) and Expression (76) in Embodiment 3.

In each embodiment of the present invention, it becomes possible to cause the theoretical pump flow rates on the suction side and the discharge side to be perfect fixed values, cause the flow rate fluctuation to be zero, and significantly reduce the pressure pulsation by satisfying all of the related relational expressions of each embodiment. However, even when the pump flow rate is not a perfect fixed value, the object of the present invention to reduce the pressure pulsation can be achieved to a certain degree when the flow rate fluctuation can be reduced. In that sense, not all of the relational expressions need to be satisfied and only some may be satisfied, and each relational expression only needs to be substantially established even when the relational expressions are not completely established.

As a specific case, it is most desired that $\beta$ be within a range expressed by Expression (10). However, the change in the distance from the rotor center in the vicinity of the interval of $\beta$ of the cam ring is minute, and hence the effect of reducing the flow rate fluctuation is considerably obtained when $\beta$ is within a range that is 0.9 times of a or more and is close to Expression (10) even when $\beta$ is outside the range. It is most desired that the left-hand side and the right-hand side in each of the expressions of Expression (12), Expression (48), Expression (49), and Expression (72) match with each other, but the effect of reducing the flow rate fluctuation can be obtained as well when the left-hand side is a close value within a range of 0.9 times to 1.1 times of the right-hand side even when the left-hand side and the right-hand side do not completely match with each other.

In particular, even when Expression (4) to Expression (9) that give forms of the motion of the vanes in the slit direction in accordance with the rotor rotation in all of the structure examples as the third configuration condition of the invention and each expression rewritten for each embodiment are not exactly established, a motion similar to those expressions only need to be given to the vanes. The motion of the vanes in the slit direction does not necessarily need to be directly defined, and a cam ring profile that gives a similar motion to the vanes may be defined. At this time, it becomes possible to determine what kind of motion of the vanes is a motion equivalent to the above and what kind of a cam ring profile can give the similar motion to the vanes by analyzing features of the functional forms of Expression (4) to Expression (9) that are basic expressions that define the motion form of the vanes.

Expression (4), Expression (6), Expression (7), and Expression (9) out of Expression (4) to Expression (9) described above are expressions that define the motion form of the vanes by intervals in which the function $L(\theta_r)$ becomes a curve. Those expressions are all characterized in being a functional form including a periodic function of which period is the interval $\gamma_1+\gamma_3=2\gamma_1$. Here, the functional form of $L(\theta_r)$ in FIG. 30 of Embodiment 3 is taken as a specific example and is compared with another functional form that does not have the feature described above. Embodiment 3 is different from the other embodiments and does not have portion intervals in which $L(\theta_r)$ linearly changes in the second interval and the fourth interval, and hence $L(\theta_r)$ becomes a curve in the entirety of those intervals. Here, L in those intervals is given by Expression (75) and Expression (76) with use of $\theta$ that is zero in the starting ends of the intervals where $\theta=\theta_r-\theta_1$ is satisfied in the second interval and $\theta=\theta_r-\theta_1-\theta_2-\theta_3$ is satisfied in the fourth interval. However, those functional forms include periodic functions of which period is $\gamma_1(=2\gamma_1)$ that is an interval in which $L(\theta)$ is a curve and has the feature described above as well.

FIG. 34 shows a motion form example of the vanes that do not have the third configuration condition of the present invention. Here, L of the second interval and the fourth interval in FIG. 34 is given by Expression (91) and Expression (92) with use of $\theta$ that is zero at the starting end of the intervals as well. The period of the periodic function in those expressions is $2\gamma$ and is obviously different from Expression (75) and Expression (76), but a term of a linear function of $\theta$ is added besides terms of the periodic function in Expression (75) and Expression (76), and $L(\theta_r)$ in FIG. 30 and $L(\theta_r)$ in FIG. 34 look similar in that both smoothly connect the minimum value and the maximum value to each other. However, the difference becomes obvious when the above is differentiated by $\theta_r$.

[Expression 91]

$$L(\theta) = -\frac{L_{max} - L_{min}}{2} \cdot \cos\left(2\pi\frac{\theta}{2\gamma}\right) + \frac{L_{max} - L_{min}}{2} \quad (91)$$

in the entire region of the second interval $0 \leq \theta < \gamma$

[Expression 92]

$$L(\theta) = \frac{L_{max} - L_{min}}{2} \cdot \cos\left(2\pi\frac{\theta}{2\gamma}\right) + \frac{L_{max} - L_{min}}{2} \quad (92)$$

in the entire region of the fourth interval $0 \leq \theta < \gamma$

In each of the second interval and the fourth interval in which the vanes perform the movement in the radial direction, $dL/d\theta_r$ in FIG. 35 obtained by differentiating $L(\theta_r)$ in FIG. 34 by $\theta_r$ becomes a half-period of a periodic function of which period is $2\gamma(=4\gamma_1)$ that is twice as much as the interval by Expression (91) and Expression (92), and $dL/d\theta_r$ becomes a function which does not have an inflection point on the inside of interval and in which gradients on both ends of the interval do not become zero. Meanwhile, in both of the second interval and the fourth interval, $dL/d\theta_r$ in FIG. 36 obtained by differentiating $L(\theta_r)$ in FIG. 30 of the present invention by $\theta_r$ becomes one period of a periodic function of which period is the interval, and dL/der becomes a function which has two inflection points the inside of the interval and in which the gradient becomes zero on both ends of the interval. The motion of the vanes in the third configuration condition of the present invention is characterized in that $dL/d\theta_r$ has gradients that become zero on both ends and two inflection points on the inside, and it can be confirmed that a similar motion is given to the vanes by confirming the feature.

FIG. 37 shows a cam ring inner-circumference profile 54*a* that causes the movement of the vanes in FIG. 30 by polar coordinates in which an origin that is the center of the rotor 52 is the pole and the X-axis is the initial side. The distance R from the origin that is a point on the inner circumferential profile 54*a* is indicated as a function of a deflection angle θp with respect to the X-axis. FIG. 38 is a diagram showing a curve obtained by differentiating $R(\theta_p)$ in FIG. 37 by $\theta_p$. The change of $R(\theta_p)$ and $dR/d\theta_p$ in FIG. 37 and FIG. 38 with respect to $\theta_p$ is substantially in the same tendency as the change of $L(\theta_r)$ and $dL/d\theta_r$ in FIG. 30 and FIG. 36 with respect to $\theta_r$, and it can be understood that the feature of the motion form of the vanes also appears in the feature of the cam ring inner-circumference profile.

In particular, a feature in which $dR/d\theta_p$ has gradients that become zero on both ends of the interval and has two inflection points on the inside of the interval in the interval of $\theta_p$ corresponding to the second interval and the fourth interval in which the vanes perform movement in the radial direction in FIG. 38 can be confirmed. Therefore, it can be confirmed that a motion similar to the motion form of the vanes that is the third configuration condition of the present invention is given to the vanes also by confirming that the cam ring inner-circumference profile itself has this feature. The confirmation of whether the given cam ring inner-circumference profile has the feature is easier with $dR/d\theta_p$ because only the shape of the cam ring alone needs to be measured as compared to $dL/d\theta_r$ where the relationship between $\theta_r$ and $L(\theta_r)$ needs to be actually measured while the rotor is rotated in a pump assembled state.

In each structure example of the present invention, there are structure examples in which there is the offset $O_f$ in the rotor slit as in the first structure example and the third structure example of Embodiment 1 and the structure example of Embodiment 3 and structure examples in which there are no offsets ($O_f$=0) as in the second structure example of Embodiment 1 and the structure example of Embodiment 2, but $O_f$ is not included in expressions that give $Q_s(t)$ and $Q_d(t)$ that are the pump flow rates of each structure example as a variable. This means that present invention exhibits effects by the first to third configuration conditions regardless of whether there is the offset $O_f$. The rotors in each structure example of the present invention have an outer circumference surface having a cylindrical shape, but a rotor having any outer circumference surface shape may be used in the present invention. This is because the volume of each working chamber is only changed by a fixed amount that is the amount of a difference in the outer circumference surface shape, and hence the change pattern of the pump flow rate is not different from that in each structure example of the present invention.

In each embodiment of the present invention, the cam ring position is fixed with respect to the rotor rotation center position, but the present invention can also be applied to a variable capacity structure that can change the flow rate for one rotor rotation by moving the cam ring position with respect to the rotor rotation center position. When some of the configuration conditions of the present invention are satisfied when the cam ring is in a certain position with respect to the rotor rotation center position, effects similar to those of each embodiment of the present invention are obtained in that position or a position in the vicinity of the position.

Lastly, the rotary-vane-type hydraulic pump is provided in all of the structure examples of the embodiments of the present invention above, but the present invention functions as a hydraulic motor when those suction side and discharge side are caused to be opposite and a high-pressure working fluid is supplied. When any of the structures in each structure example of the present invention is applied at this time, effects in which the flow rate fluctuation on the suction side and the discharge side of the hydraulic motor becomes minute, for example, is obtained in a completely similar manner as the case of the hydraulic pump. In other words, the present invention is also applicable to a rotary-vane-type hydraulic motor.

INDUSTRIAL APPLICABILITY

According to the present invention, the present invention can be used in manufacturing industries and the like of a displacement hydraulic pump, a hydraulic motor, and the like.

REFERENCE SIGNS LIST

1, 11: shaft member, 2, 12, 22, 32, 42, 52: rotor, 2*a*, 12*a*: rotor slit, 3, 13, 23, 33, 43, 53: vane, 4, 14: cam ring, 4*a*, 14*a*, 24*a*, 34*a*, 44*a*, 54*a*: cam ring inner-circumference profile, 4*b*: pump inflow port, 4*c*: pump outflow port, 5: side plate F, 5*a*, 15*a*, 25*a*, 35*a*, 45*a*, 55*a*: suction port F, 5*b*, 15*b*, 25*b*, 35*b*, 45*b*, 55*b*: discharge port F, 5*c*, 15*c*: back pressure groove F, 6: side plate R, 6*a*, 16*a*, 26*a*, 36*a*, 46*a*, 56*a*:

suction port R, 6*b*, 16*b*, 26*b*, 36*b*, 46*b*, 56*b*: discharge port R, 6*c*, 16*c*: back pressure groove R $\theta_r$: rotor rotation angle with reference to X-axis positive direction $\theta$: rotor rotation angle based on position in which vane distal end comes into contact at starting end of radial-direction movement interval $\omega$: angular velocity t: time $R_v$: radius of vane distal end circular arc $P_0$: center point of vane distal end circular arc O: rotor center point $O_f$: offset amount from rotor center of $P_0$ to opposite rotation side in direction perpendicular to rotor slit L: rotor-slit-direction distance between rotor center point O and center point $P_0$ of vane distal end circular arc $L_{min}$: minimum value of L $L_{max}$: maximum value of L $\theta_1$ to $\theta_5$: change amount of $\theta_r$ in each interval sectioned in accordance with change state of L $\alpha$: angle between adjacent rotor slits $\beta$: change amount of $\theta_r$ in interval in which L is fixed values such as $L_{min}$ and $L_{max}$ $\gamma$: change amount of $\theta_r$ in intervals such as $\theta_2$ and $\theta_4$ in which vane performs radial-direction movement $\gamma_1$: change amount of $\theta_r$ in first portion in interval of $\theta_r$ of change amount $\gamma$ $\gamma_2$: change amount of $\theta_r$ in second portion in interval of $\theta_r$ of change amount $\gamma$ $\gamma_3$: change amount of $\theta_r$ in third portion in interval of $\theta_r$ of change amount $\gamma$ $\alpha'$: angle between rotor slits of two vanes sandwiching second portion $N_v$: number of vanes n: integer of 2 or more by factor of $\gamma$ with respect to $\alpha$ $n_1$: natural number that is common factor of $\gamma_1$ and 13 with respect to $\alpha$ $n_2$: natural number that is factor of $\gamma_2$ with respect to $\alpha$ S, $S_n$: front area of working chamber in suction stroke or discharge stroke and area identified by applying numbers to all working chamber front areas in corresponding stroke at same time $S_t$: total of all working chamber front areas in one suction stroke or discharge stroke at same time W: thickness of cam ring T: thickness of vane $D_r$: diameter of rotor $R_r$: rotor outer circumference radius $D_c$: diameter of cam ring inner circumference having perfect circle profile R: distance of point on cam ring inner circumference profile from rotor center (origin)

$\theta_p$: deflection angle of which initial side is X-axis of point on cam ring inner circumference profile $R_{max}$: maximum value of R $R_{min}$: minimum value of R $Q_s$: pump flow rate on suction side by one suction stroke portion $Q_d$: pump flow rate on discharge side by one discharge stroke portion $M_1$ to $M_{2n1}$: number of $2n_1$ mass points that is same in mass point and disposed at even intervals on circumference having radius of 1 shown in FIG. 29

$P_{i\text{-}j}$: contact point between cam ring inner circumference and vane in boundary between i-th interval and j-th interval of $\theta_r$ $P_{k\text{-}l\text{-}m}$: contact point between cam ring inner circumference and vane in boundary between l-th portion and m-th portion in k-th interval of $\theta_r$ $S_{s1}$, $S_{s2}$, $S_{s3}$: front area of each working chamber on suction side shown by hatching in FIG. 13 and FIG. 16

$S_{d1}$, $S_{d2}$, $S_{3d}$: front area of each working chamber on discharge side shown in FIG. 13 and FIG. 16

$S_{s0}$: front area of suction side portion shown by hatching in FIG. 14 and FIG. 17

$S_{d0}$: front area of suction side portion shown by hatching in FIG. 14 and FIG. 17

$S_{sv1}$, $S_{sv2}$, $S_{sv3}$, $S_{sv4}$: front area of each vane distal end portion on suction side shown by hatching in FIG. 15 and FIG. 18

$S_{sv5}$: front area of fifth vane distal end portion on suction side $S_{dv1}$, $S_{dv2}$, $S_{dv3}$, $S_{dv4}$: front area of each vane distal end portion on discharge side shown by hatching in FIG. 15 and FIG. 18

$V_{st}$: total of volumes of all working chambers in suction stroke $V_{dt}$: total of volumes of all working chambers in discharge stroke

The invention claimed is:

1. A machine, comprising:

a shaft member;

a rotor that rotates about a rotor central axis with the shaft member and has a plurality of slits formed at an even interval of a constant angle ($\alpha$), the plurality of slits being opened to an outer circumference;

a cam ring having an inner-circumferential-surface having a smooth closed curve in which a distance from the rotor central axis increases and decreases once or twice during one rotation around the rotor;

a plurality of vanes each slidably fitted into the corresponding slits in the rotor, a distal end of each vane being biased to be in constant contact with the inner circumferential surface of the cam ring;

two side plates that each close each opening portion of the cam ring in an axial direction; and a bearing member that is integrated with or fixed to the side plates and rotatably supports the shaft member, wherein the machine is configured to function as a liquid pump or a hydraulic motor by increasing or decreasing each of a plurality of working space volumes surrounded by the cam ring, the rotor, the two side plates, and the adjacent vanes in accordance with a rotation of the rotor and the shaft member, the inner-circumferential-surface of the cam ring comprises one or two pairs of large and small circular arc portions having which are defined by large and small constant distances from the rotor central axis, respectively, the large constant distance being larger than the small constant distance, each central angle ($\beta$) of the large and small circular arc portions around the rotor central axis being 0.9 times or more of the constant angle ($\alpha$) between the adjacent slits;

the cam ring is fixed to the bearing member; and a number of the vanes is five or six when there is only one pair of the large and small circular arc portions and is ten when there are two pairs of the large and small circular arc portions.

2. A machine, comprising:

a shaft member;

a rotor that rotates about a rotor central axis with the shaft member and has a plurality of slits formed at an even interval of a constant angle ($\alpha$), the plurality of slits being opened to an outer circumference;

a cam ring having an inner-circumferential-surface having a smooth closed curve in which a distance from the rotor central axis increases and decreases once or a plurality of times during one rotation around the rotor;

a plurality of vanes each slidably fitted into the corresponding slits in the rotor, a distal end of each vane being biased to be in constant contact with the inner circumferential surface of the cam ring;

two side plates that each close each opening portion of the cam ring in an axial direction; and a bearing member that is integrated with or fixed to the side plates and rotatably supports the shaft member, wherein the machine is configured to function as a liquid pump or a hydraulic motor by increasing or decreasing each of a plurality of working space volumes surrounded by the cam ring, the rotor, the two side plates, and the adjacent vanes in accordance with a rotation of the rotor and the shaft member, the inner-circumferential-surface of the cam ring comprises one or plural pairs of large and small circular arc portions which are defined by large and small constant distances from the rotor central axis, respectively, the large constant distance being larger than the small constant distance, each central angle ($\beta$) of the large and small circular arc portions around the rotor central axis being 0.9 times or more of the constant angle ($\alpha$) between the adjacent slits, and the inner-circumferential-surface of the cam ring further comprises interval circular arc portions connecting the large circular arc portion and the small circular arc portion therebetween, a profile of at least one of the interval circular arc portions being defined by a function ($R(\theta_p)$) of a distance (R) from the rotor central axis with respect to a central deflection angle ($\theta_p$) around the rotor central axis, and the profile of the inner-circumferential-surface satisfies the following requirement: when a curve obtained by differentiating the function ($R(\theta_p)$) by the central deflection angle ($\theta_p$) becomes zero at both ends of each interval circular arc portion and has two inflection points inside the ends.

3. The machine according to claim 2, wherein the inner-circumferential-surface profile of the cam ring satisfies the following requirement: a total of differential values obtained by differentiating the function ($R(\theta_p)$) by the central deflection angle ($\theta_p$) at portions of the distal ends of all of the vanes that are in contact with one of the interval circular arc portions is substantially constant.

4. The machine according to claim 2, wherein:

at least one of the interval circular arc portions comprises a first portion, a second portion, and a third portion that are smoothly connected to each other in this order, the first, second, third portions being defined by first, second, and third central angles ($\gamma_1$, $\gamma_2$ and $\gamma_3$) around the rotor central axis, respectively, the first central angle ($\gamma_1$) and the third central angle ($\gamma_3$) are equal to each other or one of the first central angle ($\gamma_1$) and the third central angle ($\gamma_3$) is in a range of from 0.9 times to 1.1 times of the other, the function ($R(\theta_p)$) within the second central angle ($\gamma_2$) being substantially a linear function, and a periodic function of which period is $\gamma_1+\gamma_3$ in the first portion and the third portion, and a differential value of the function ($R(\theta_p)$)–$R(\theta_p)$ by the central deflection angle ($\theta_p$) becomes a same value at a terminal end of the first portion and a starting end of the third portion and becomes a constant value in the second portion, the constant value in the second portion being equal to the same value at the terminal end of the first portion and the starting end of the third portion.

5. The machine according to claim 4, wherein each of a total of the first central angle ($\gamma_1$) and the second central angle ($\gamma_2$) and a total of the third central angle ($\gamma_3$) and the second central angle ($\gamma_2$) is equal to the constant angle ($\alpha$) between the adjacent slits is a value within 0.9 times or 1.1 times of the constant angle ($\alpha$).

6. The machine according to claim 4, wherein each of the first central angle ($\gamma_1$), the second central angle ($\gamma_2$), and the third central angle ($\gamma_3$) is a positive integral multiple of the constant angle ($\alpha$) between the adjacent slits or is at least a value within 0.9 times or 1.1 times of the constant angle ($\alpha$).

7. The machine according to claim 4, wherein a magnitude of the second central angle ($\gamma_2$) is zero in the interval circular arc portion, and a sum ($\gamma$) of the first central angle ($\gamma_1$) and the third central angle ($\gamma_3$) is an integral multiple of 2 or more of the constant angle ($\alpha$) between the adjacent slits or a value within a range that is 0.9 times to 1.1 times of the constant angle ($\alpha$).

8. A machine, comprising:

a shaft member;

a rotor that rotates about a rotor central axis with the shaft member and has a plurality of slits formed at an even interval of a constant angle ($\alpha$), the plurality of slits being opened to an outer circumference;

a cam ring having an inner-circumferential-surface having a smooth closed curve in which a distance from the rotor central axis increases and decreases once or a plurality of times during one rotation around the rotor;

a plurality of vanes each slidably fitted into the corresponding slits in the rotor, a distal end of each vane being biased to be in constant contact with the inner circumferential surface of the cam ring, the distal end of each vane being defined by a circular arc, a slit direction displacement (L) being defined as a distance from the rotor central axis to a center of the circular arc of each vane;

two side plates that each close each opening portion of the cam ring in an axial direction; and a bearing member that is integrated with or fixed to the side plates and rotatably supports the shaft member, wherein the machine is configured to function as a liquid pump or a hydraulic motor by increasing or decreasing each of a plurality of working space volumes surrounded by the cam ring, the rotor, the two side plates, and the adjacent vanes in accordance with a rotation of the rotor and the shaft member, the inner-circumferential-surface of the cam ring comprises one or plural pairs of large and small circular arc portions which are defined by large and small constant distances from the rotor central axis, respectively, the large constant distance being larger than the small constant distance, each central angle ($\beta$) of the large and small circular arc portions around the rotor central axis being 0.9 times or more of the constant angle ($\alpha$) between the adjacent slits, and the inner-circumferential-surface of the cam ring further comprises interval circular arc portions connecting the large circular arc portion and the small circular arc portion therebetween, a profile of at least one of the interval circular arc portions being defined by a function ($L(\theta_r)$) of the slit direction displacement (L) with respect to a central deflection angle ($\theta_r$) around the rotor central axis, and the profile of the inner-circumferential-surface satisfies the following requirement: when a curve obtained by differentiating the function ($L(\theta_r)$) by the central deflection angle ($\theta_r$) becomes zero at both ends of each interval circular arc portion and has two inflection points inside the ends.

9. The machine according to claim 8, wherein the profile of the inner-circumferential-surface of the cam ring satisfies the following requirement: a total of differential values obtained by differentiating the function ($L(\theta_r)$) by the central deflection angle ($\theta_r$) at positions of the distal ends of all of the vanes that are in contact with one of the interval circular arc portions is substantially constant.

10. The machine according to claim 8, wherein:

at least one of the interval circular arc portions comprises a first portion, a second portion, and a third portion that are smoothly connected to each other in this order, the first, second, third portions being defined by first, second, and third central angles ($\gamma_1$, $\gamma_2$ and $\gamma_3$) around the rotor central axis, respectively, the first central angle ($\gamma_1$) and the third central angle ($\gamma_3$) are equal to each other or one of the first central angle ($\gamma_1$) and the third central angle ($\gamma_3$) is in a range of from 0.9 times to 1.1 times of the other, the function ($L(\theta_r)$) within the second central angle ($\gamma_2$) being substantially a linear function, and a periodic function of which period is $\gamma_1+\gamma_3$ in the first portion and the third portion, and a differential value of the function ($L(\theta_r)$) by the central deflection angle ($\theta_r$) becomes a same value at a terminal end of the first portion and a starting end of the third portion and becomes a constant value in the second portion, the constant value in the second portion being equal to the same value at the terminal end of the first portion and the starting end of the third portion.

11. The machine according to claim 10, wherein each of a total of the first central angle ($\gamma_1$) and the second central angle ($\gamma_2$) and a total of the third central angle ($\gamma_3$) and the second central angle ($\gamma_2$) is equal to the constant angle ($\alpha$) between the adjacent slits or is a value within 0.9 times or 1.1 times of the constant angle ($\alpha$).

12. The machine according to claim 10, wherein each of the first central angle ($\gamma_1$), the second central angle ($\gamma_2$), and the third central angle ($\gamma_3$) is a positive integral multiple of the constant angle ($\alpha$) between the adjacent slits or is at least a value within 0.9 times or 1.1 times of the constant angle ($\alpha$).

13. The machine according to claim 10, wherein a magnitude of the second central angle ($\gamma_2$) is zero in the interval circular arc portion, and a sum ($\gamma$) of the first central angle ($\gamma_1$) and the third central angle ($\gamma_3$) is an integral multiple of 2 or more of the constant angle ($\alpha$) between the adjacent slits or a value within a range that is 0.9 times to 1.1 times of the constant angle ($\alpha$).

14. A machine, comprising:

a shaft member;

a rotor that rotates about a rotor central axis with the shaft member and has a plurality of slits formed at an even interval of a constant angle ($\alpha$), the plurality of slits being opened to an outer circumference;

a cam ring having an inner-circumferential-surface having a smooth closed curve in which a distance from the rotor central axis increases and decreases once or a plurality of times during one rotation around the rotor;

a plurality of vanes each slidably fitted into the corresponding slits in the rotor, a distal end of each vane being biased to be in constant contact with the inner circumferential surface of the cam ring, the distal end of each vane being defined by a circular arc, a slit direction displacement (L) being defined as a distance from the rotor central axis to a center of the circular arc of each vane;

two side plates that each close each opening portion of the cam ring in an axial direction; and a bearing member that is integrated with or fixed to the side plates and rotatably supports the shaft member, wherein the machine is configured to function as a liquid pump or a hydraulic motor by increasing or decreasing each of a plurality of working space volumes surrounded by the cam ring, the rotor, the two side plates, and the adjacent vanes in accordance with a rotation of the rotor and the shaft member, the inner-circumferential-surface of the cam ring comprises one or plural pairs of large and small circular arc portions which are defined by large and small constant distances from the rotor central axis, respectively, the large constant distance being larger than the small constant distance, the small arc portion being defined by a small constant distance smaller than the large constant distance, each central angle ($\beta$) of the large and small circular arc portions around the rotor central axis being 0.9 times or more of the constant angle ($\alpha$) between the adjacent slits, the inner-circumferential-surface of the cam ring further comprises interval circular arc portions connecting the large circular arc portion and the small circular arc portion therebetween, at least one of the interval circular arc portions comprising a first portion, a second portion, and a third portion that are smoothly connected to each other in this order, the first, second, third portions being defined by first, second, and third central angles ($\gamma_1$, $\gamma_2$ and $\gamma_3$) around the rotor central axis, respectively, the first central angle ($\gamma_1$) and the third central angle ($\gamma_3$) are equal to each other or one of the first central angle ($\gamma_1$) and the third central angle ($\gamma_3$) is in a range of from 0.9 times to 1.1 times of the other, and a profile of the second portion is defined by a function ($L(\theta_r)$) of the slit direction displacement (L) with respect to a central deflection angle ($\theta_r$) around the rotor central axis and satisfies the following requirement: the function ($L(\theta_r)$) within the second central angle ($\gamma_2$) is substantially a linear function.

15. The machine according to claim 14, wherein each of a total of the first central angle ($\gamma_1$) and the second central angle ($\gamma_2$) and a total of the third central angle ($\gamma_3$) and the second central angle ($\gamma_2$) is equal to the constant angle ($\alpha$) between the adjacent slits or is a value within 0.9 times or 1.1 times of the constant angle ($\alpha$).

16. The machine according to claim 14, wherein each of the first central angle ($\gamma_1$), the second central angle ($\gamma_2$), and the third central angle ($\gamma_3$) is a positive integral multiple of the constant angle ($\alpha$) between the adjacent slits or is at least a value within 0.9 times or 1.1 times of the constant angle ($\alpha$).

17. The machine according to claim 14, wherein a magnitude of the second central angle ($\gamma_2$) is zero in the interval circular arc portion, and a sum ($\gamma$) of the first central angle ($\gamma_1$) and the third central angle ($\gamma_3$) is an integral multiple of 2 or more of the constant angle ($\alpha$) between the adjacent slits or a value within a range that is 0.9 times to 1.1 times of the constant angle ($\alpha$).

* * * * *